US007524020B2

(12) United States Patent
Eguchi et al.

(10) Patent No.: US 7,524,020 B2
(45) Date of Patent: Apr. 28, 2009

(54) LIQUID EJECTING HEAD AND LIQUID EJECTING APPARATUS

(75) Inventors: Takeo Eguchi, Kanagawa (JP); Minoru Kohno, Tokyo (JP); Kazuyasu Takenaka, Tokyo (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 62 days.

(21) Appl. No.: 11/277,180

(22) Filed: Mar. 22, 2006

(65) Prior Publication Data

US 2006/0214975 A1 Sep. 28, 2006

(30) Foreign Application Priority Data

Mar. 25, 2005 (JP) ..... P2005-087430

(51) Int. Cl.
*B41J 2/155* (2006.01)

(52) U.S. Cl. ..... 347/42; 347/13; 347/43

(58) Field of Classification Search ..... 347/13, 347/42, 43

See application file for complete search history.

(56) References Cited

U.S. PATENT DOCUMENTS 4,794,411 A 12/1988 Taub et al.
6,155,670 A 12/2000 Weber et al.
6,527,376 B1 3/2003 Itaya et al.
2001/0030669 A1 10/2001 Mizutani
2002/0140772 A1* 10/2002 Torgerson et al. ..... 347/43
2005/0046658 A1* 3/2005 Kojima ..... 347/19

FOREIGN PATENT DOCUMENTS

JP P2001-010056 1/2001
JP 2003-037343 2/2003

OTHER PUBLICATIONS

European Search Report dated Jul. 13, 2006.

* cited by examiner

*Primary Examiner*—Matthew Luu
*Assistant Examiner*—Justin Seo
(74) *Attorney, Agent, or Firm*—Sonnenschein Nath & Rosenthal LLP

(57) ABSTRACT

A liquid ejecting head includes a plurality of arrays of liquid ejecting portions each having a nozzle for ejecting a droplet. The nozzle is arranged along each of an imaginary straight line R1 and an imaginary straight line R2 that are arranged in parallel at a distance δ from each other, and a distance, with respect to the direction of the imaginary straight lines R1 and R2, between two adjacent ones of the nozzles respectively arranged on the imaginary straight line R1 and the imaginary straight line R2 is set to a fixed value P. The liquid ejecting portions arrayed along at least one of the imaginary straight lines R1 and R2 are formed so that a liquid is ejected from each of the liquid ejecting portions while being deflected to the other imaginary straight line side.

12 Claims, 23 Drawing Sheets

16
16
16
COMMON PASSAGE
NOZZLE ROW R1
NOZZLE ROW R2
INTER-NOZZLE-ROW DISTANCE (δ)

16
NOZZLE PITCH (P)
PRESSURE CENTER
18
13
PRESSURE CENTER
COMMON PASSAGE

TETRAGONAL LATTICE ARRAY

STAGGERED LATTICE ARRAY

FIG. 11

| ITEMS | SPECIFICATIONS | UNIT |
|---|---|---|
| EJECTION STRUCTURE | OPPOSED LIQUID CHAMBERS | μm |
| VOLUME OF INK LIQUID CHAMBER 12 (W×D×H) | 32×25×9.5 | |
| HEATER ELEMENT 13 (TANTALUM) | 20×20 (HALF-SPLIT) | |
| NOZZLE PLATE 17 (NOZZLE THICKNESS) | NICKEL ELECTROCASTING (13±1) | |
| NOZZLE 18 (ORIFICE) DIAMETER | 14 ϕ | |
| OFFSET AMOUNT hc BETWEEN CENTROID OF HEATER ELEMENT 13 AND CENTER OF NOZZLE 18 | 0 TO 2.5 | |

EJECTION DIRECTION OF INK DROPLETS DETERMINED FROM RECORDING PATTERN

EXAMPLE OF DOTS RECORDED WHEN hc=0

EJECTION DIRECTION OF INK DROPLETS DETERMINED FROM RECORDING PATTERN

EXAMPLE OF DOTS RECORDED WHEN hc=1.5 [μm]

EJECTION DIRECTION OF INK DROPLETS DETERMINED FROM RECORDING PATTERN

EXAMPLE OF DOTS RECORDED WHEN hc=2.5 [μm]

FIG. 17

| ITEMS | SPECIFICATIONS | UNIT |
|---|---|---|
| EJECTION STRUCTURE | PRESSURE GROOVE TYPE | μm |
| GROOVE DIMENSIONS (W×D×H) | 32×90×11 | |
| HEATER ELEMENT 13 (TANTALUM) | 20×20 (HALF-SPLIT) | |
| NOZZLE PLATE 17 (NOZZLE THICKNESS) | NICKEL ELECTROCASTING (13 ± 1) | |
| NOZZLE 18 (ORIFICE) DIAMETER | 16 Φ | |
| OFFSET AMOUNT hc BETWEEN CENTROID OF HEATER ELEMENT 13 AND CENTER OF NOZZLE 18 | 0 | |

LIQUID EJECTING HEAD AND LIQUID EJECTING APPARATUS

CROSS REFERENCES TO RELATED APPLICATIONS

The present invention contains subject matter related to Japanese Patent Application JP 2005-087430 filed in the Japanese Patent Office on Mar. 25, 2005, the entire contents of which are incorporated herein by reference.

BACKGROUND OF THE INVENTION

1. Field of the Invention

The present invention relates to a liquid ejecting head and a liquid ejecting apparatus in which even when liquid ejecting portions are arrayed in a staggered manner in the arrangement direction of the liquid ejecting portions, the impacted dot rows are arranged on a substantially straight line.

2. Description of the Related Art

When attempting to realize a nozzle (liquid ejecting portion having a nozzle) row at as fine pitch as possible in a liquid ejecting apparatus or the like, when nozzles are arranged along one straight line, the distance between adjacent nozzles and the nozzle pitch become equal to each other. In contrast, when the nozzles are sequentially arranged in a staggered fashion along a plurality of straight lines, the distance between the nozzles can be made larger than the nozzle pitch.

FIGS. 22A and 22B illustrate this state. FIG. 22A illustrates a case where the nozzles are arrayed in a straight line, and FIG. 22B illustrates a case where the nozzles are arrayed in a staggered manner. In FIG. 22B, there are two nozzle rows R1 and R2. At this time, the distance between the nozzle rows R1 and R2 is δ. Further, the pitch in the arrangement direction of the nozzles is P that is the same as the pitch in FIG. 22A.

Accordingly, while the distance between the centers of the nozzles (nozzle pitch) is P in FIG. 22A, in the case of FIG. 22B, the distance between the centers of the adjacent nozzles is "$\sqrt{(P^2+\delta^2)}$" and thus can be made longer than that in the case of FIG. 22A.

This is also reflected in impact dot rows indicated at the bottom of FIGS. 22A and 22B. That is, normally, a dot formed as an ink droplet impacts on a recording medium remains as a substantially circular dot and, at least in the case of an ordinary inkjet head, the amount of the droplet is suitably selected so that the diameter thereof becomes substantially equal to the recording pitch. Therefore, in the array of FIG. 22A, adjacent dots are substantially in contact with each other. In contrast, in the case of FIG. 22B, the adjacent dots are arranged in a staggered array, thus leaving a gap therebetween.

Further, there have been disclosed various methods aimed at making the flight direction of ink droplets ejected from the nozzles coincide with or close to the directing of the normal passing through the center of each nozzle.

For example, there have been disclosed a method in which, as disclosed in Japanese Patent No. 2720989, the centerline of each nozzle is offset to the ink supply side with respect to the center of the resistor, a method in which, as disclosed in Japanese Unexamined Paten Application Publication No. 2001-10056, the centerline of the nozzle is offset in the opposite direction, that is, the centerline of the nozzle is placed toward the rear side of the ink liquid chamber with respect to the center of the ink liquid chamber, and the like (Note that as mentioned above, the direction in which the center of the nozzle is offset is opposite between Japanese Patent No. 2720989 and Japanese Unexamined Paten Application Publication No. 2000-110056).

SUMMARY OF THE INVENTION

Incidentally, when ink droplets are ejected perpendicularly to the nozzle surface using a head of a staggered array with the distance δ provided between nozzles rows (hereinafter, referred to as the "inter-nozzle-row distance" δ), as a matter of course, an offset σ on the same order as the distance δ between the staggered nozzle arrays is present between adjacent dots (see FIG. 22B).

Here, the distance δ between staggered arrays on the nozzle side and the distance σ between dot rows formed by the ejected droplets are not strictly the same. This is due to the two factors as described below.

First, the ejection angle of ink droplets is not a fixed value. Normally, after exiting the nozzle, an ink droplet flies in the air before impact. Accordingly, at the time when the ink droplet exits each nozzle, the ejection direction varies for each of the nozzles due to a difference in wettability or deposition of contaminants caused by the slightest of stain on the nozzle surface (particularly near the orifice), a slight difference in nozzle configuration, or the like. When microscopically observed, it is considered that all the ink droplets are ejected from the nozzle surfaces at difference ejection angles before impacting on the recording medium. That is, although the distance between the nozzle rows is δ, the distance between the impacted dot rows does not become δ; it is reasonable to define the distance as σ including such variations. Of course, when the distance between each nozzle and the recording medium is small, the distance σ between the dot rows becomes close to the distance δ between the nozzle arrays.

Second, the head and the recording medium move relative to each other.

In this regard, since supply of ink to the respective nozzles is normally made through a common passage, when ink droplets are ejected at once from a plurality of nozzles, the problem of interference occurs (the pressure at the time of ink supply varies due to interference). The variation in pressure due to interference is a common problem that is liable to occur when a common passage is used to supply ink, and this may lead to a deterioration in image quality such as density unevenness in the case of an inkjet printer or the like.

In view of this, in order to suppress this problem to a practically unproblematic level, nozzles that can number in several hundreds in ink jet printers, for example, are divided to several groups of nozzles (for example, in groups of 32 nozzles, 64 nozzles, or the like due to constraints such as the refilling time of ink that is consumed by ejection). Even when, from among the groups, there are a plurality of groups with nozzles that eject ink at the same time, within each group, ink is ejected from only one nozzle at the same time (in the case of a thermal system, there is also the problem of crowding of current supplied to heater elements).

Once an ejection is performed from a specific nozzle as described above, a refilling period (time period for refilling the liquid consumed by ejection) is required until the next ejection can be performed from the same nozzle again. During this period, ejection is performed alternately or sequentially from nozzles sufficiently spaced apart from that nozzle (from which ejection has been performed). Further, there are a method in which the recording medium is made stationary relative to the head during this period and a method in which the recording medium is moved relative to the head during this period.

In the former method, the placement of dots in one cycle corresponds to the physical placement of the nozzles plus the factor described in the first point mentioned above. Generally, the obtained dot array is almost the same as the placement of the nozzles.

On the other hand, in the latter method, the dot array gradually deviates from the nozzle array pattern each time each dot undergoes impact.

FIGS. 23A and 23B illustrate this state. FIG. 23A illustrates a case with no relative movement, and FIG. 23B illustrates a case with relative movement.

In the examples of FIGS. 23A and 23B, it is assumed that ejection takes place in the cycle from the nozzles "1", "3", "5", "2", "4", and then "6" of the nozzle array. The respective numerals in the ejection cycle indicate the order of ejection during the cycle (in this case, the number of groups is one, and the size of the group is 6).

As is apparent from the examples of FIGS. 23A and 23B, when, as shown in FIG. 23A, there is no relative movement between the recording medium and the heads during one ejection cycle, the nozzle array and the dot array become similar (in this case, linear) ones.

In contrast, when, as shown in FIG. 23B, the heads and the recording medium move relative to each other, there is a problem in that the dot array obtained is affected by both the relative movement speed and the order of ejection from the nozzles and hence does not become the same as the nozzle array.

Although FIG. 23B shows a case where the relative speed between the heads and the recording medium is high, in actuality, the distance by which the heads and the recording medium shift from each other is set to one pixel during one ejection cycle even at the time of the maximum relative speed, that is, the distance is set to be just the same as the nozzle pitch P.

In order to achieve a further improvement in image quality (in order to arrange a plurality of dots within one pixel), the relative speed between the heads and the recording medium is suitably selected so that a plurality of ejection cycle periods each correspond to the distance of the one nozzle pitch P. Accordingly, the dot array of FIG. 22B shows a state that is close to the actual state.

In the case of an inkjet printer, when, in the state where the nozzle array and the dot array are substantially the same in configuration, recording signals for drawing just one dot row are sequentially supplied to the respective nozzles, a straight line (a cluster of substantially circular dots as microscopically observed) having a line width corresponding to the diameter of dots can be drawn in the case of a linear array. However, in the case of a staggered array, two rows of dots are arranged in the longitudinal direction, which causes a problem in that the line width becomes double.

However, since the dots on the same side are arranged alternately, two lines passing through the centers of dots on the respective sides and whose density is reduced by half are aligned so as to be in contact with each other. Hence, it does not mean that the resultant line of dots appears to be doubled in density.

In actuality, when the dot diameter is extremely small, and the nozzle pitch P is sufficiently small, the difference between the two cases is extremely small to an extent that it can hardly be distinguished by the naked eyes. However, in principle, the resolution with respect to the direction of relative movement between the heads and the recording medium decreases in the latter case, so this may present a problem depending on the value of P.

In the system of FIG. 23A in which the relative position between the heads and the recording medium moves in a step-like manner, normally no ejection is performed during the period of the relative movement. Accordingly, since the heads and the recording medium are stationary at the time of performing ejection, it may be impossible to use the aforementioned method. In this regard, although in the case of a staggered nozzle array the dot array also remains staggered as it is, by setting the paper feed pitch to half and adjusting the ejection signal accordingly, the dot row can be corrected to one of a linear array.

However, with the system in which the heads or the recording medium is fed in a step-like manner, there is a problem in that a certain acoustic noise is liable to occur, and the problem of noise is further exacerbated particularly when the recording is performed at high speed.

In contrast, with the system of FIG. 23B in which the relative position between the heads and the recording medium continuously moves, by setting two timings for generating the ejection signals to be supplied to the nozzles, and, of the staggered nozzles, delaying the ejection time from the nozzles only on one side, and by setting the distance on the recording medium produced due to the delay so that the dots on one side are aligned with the dots on the other side, the row of the impacted dots can be corrected from that of a staggered array to a linear array. That is, in FIG. 22B, $\sigma$ can be made to 0.

With this system, however, when the relative speed between the heads and the recording medium changes, the obtained dot array also changes (contraction occurs in the direction of relative movement between the heads and the recording medium). Thus there is a problem in that when changing the recording system, for example, the ejection timing (which is actually controlled by a memory) must be changed accordingly.

Therefore, in a liquid ejecting head or liquid ejecting apparatus having a structure in which the nozzles are arranged in a staggered array, it is desirable to make the dot array close to a straight line irrespective of the relative movement speed between the head and the recording medium or the conveying system of the recording medium.

In view of this, according to an embodiment of the present invention, there is provided a liquid ejecting head including a plurality of arrays of liquid ejecting portions each having a nozzle for ejecting a droplet, wherein: the nozzle is arranged along each of an imaginary straight line R1 and an imaginary straight line R2 that are arranged in parallel at a distance $\delta$ from each other, and a distance, with respect to the direction of the imaginary straight lines R1 and R2, between two adjacent ones of the nozzles respectively arranged on the imaginary straight line R1 and the imaginary straight line R2 is set to a fixed value P; and the liquid ejecting portions arrayed along at least one of the imaginary straight lines R1 and R2 are formed so that a liquid is ejected from each of the liquid ejecting portions while being deflected to the other imaginary straight line side.

According to the embodiment of the present invention as described above, the liquid ejected from each liquid ejecting portion on at least one of the imaginary straight line R1 and R2 sides is ejected toward the other imaginary straight line side. Accordingly, the distance between the centers of the dot rows formed when liquids are impacted on the recording medium becomes smaller than the distance between the imaginary straight lines R1 and R2.

Note that such expressions as "parallel", "orthogonal", "90 degrees", or "zero" as used in the present invention and in the description of the embodiment thereof do not mean theoretically (mathematically) perfect "parallel", "orthogonal", "90 degrees", or "zero"; what is meant by these expressions permits deviations that fall within the margin of manufacturing error or the like (their meanings include "substantially" or "almost").

Likewise, the meaning of the word "straight line" includes not only a straight line in the mathematical sense but also a line that can be regarded as a substantially or almost straight line.

According to the embodiment of the present invention, in the case where the formed dot rows are arrayed on the two imaginary straight lines, the distance between the dot rows can be made smaller than the distance between the imaginary straight lines R1 and R2, or the distance between the dot rows can be made substantially zero.

BRIEF DESCRIPTION OF THE DRAWINGS

FIG. 11 is a table showing the specifications of the head according to EXAMPLE of the present invention;

FIGS. 13A and 13B are views showing the results of an experiment according to EXAMPLE, of which FIG. 13A shows the actually formed dot rows, and FIG. 13B shows the inferred ejected direction of ink droplets;

FIGS. 14A and 14B are views showing the results of an experiment according to EXAMPLE, of which FIG. 14A shows the actually formed dot rows, and FIG. 14B shows the inferred ejected direction of ink droplets;

FIGS. 15A and 15B are views showing the results of an experiment according to EXAMPLE, of which FIG. 15A shows the actually formed dot rows, and FIG. 15B shows the inferred ejected direction of ink droplets;

FIG. 17 is a table showing the specifications of a head of a pressure groove system according to EXAMPLE;

FIGS. 23A and 23B are views each showing a dot array, of which FIG. 23A shows one involving no relative movement and FIG. 23B shows one involving relative movement.

DESCRIPTION OF THE PREFERRED EMBODIMENTS

Figure 1:
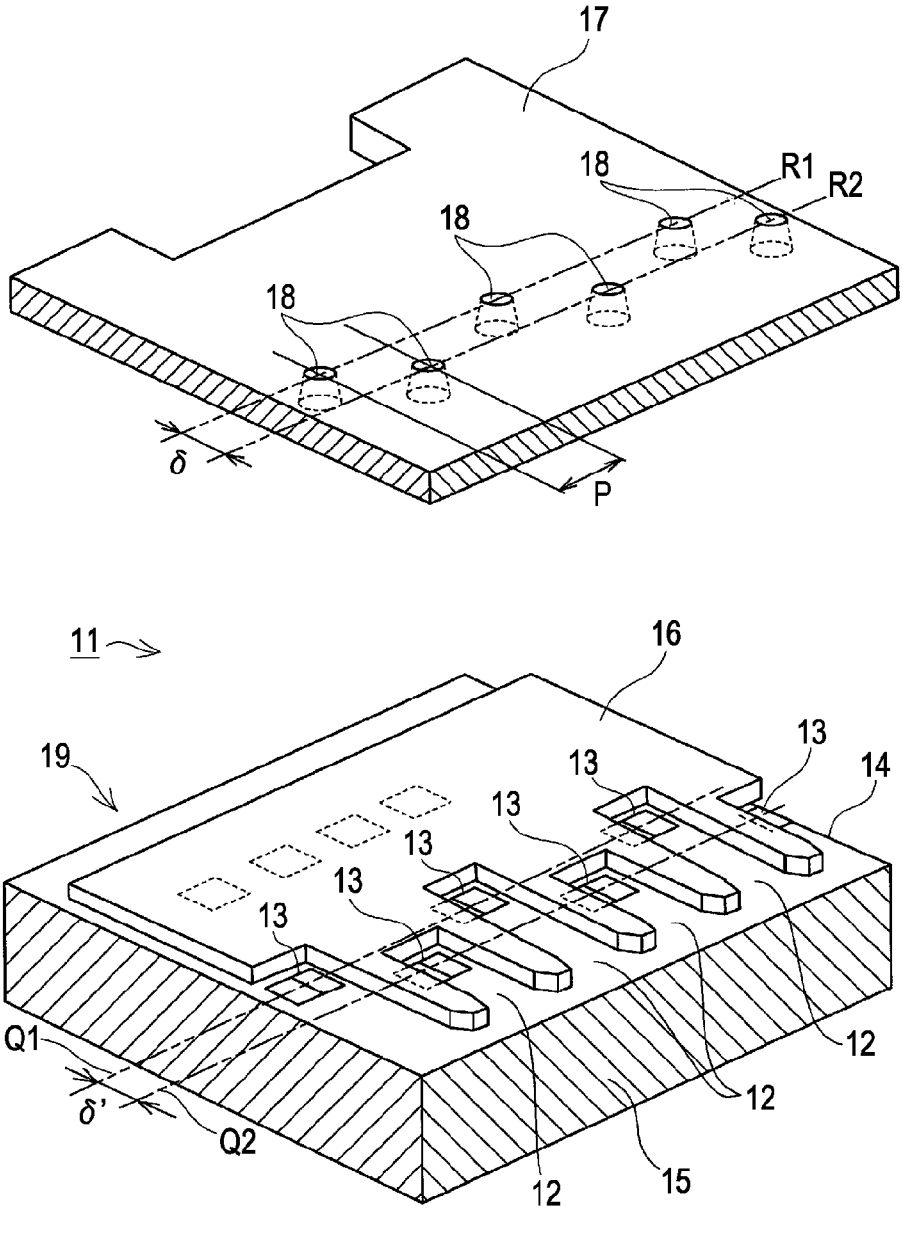
FIG. 1 is a partial perspective view showing heads according to an embodiment of the present invention.

Hereinbelow, an embodiment of the present invention will be described with reference to the drawings.

In the embodiment described below, as shown, for example, in FIG. 1, a liquid ejecting head according to the embodiment of the present invention corresponds to a (inkjet) head 11 of an inkjet printer. Further, in the embodiment described below, the head 11 is a thermal type head using heater elements (more specifically, heater resistors) 13 as ejection pressure generating elements. Further, a liquid chamber 12 is a liquid chamber containing ink, and a minute amount (for example, several pico-liters) of ink (liquid) ejected as a droplet from each of nozzles 18 is an ink droplet. Further, the target object on which ink droplets impact (target liquid-impacting object) is a recording medium (recording sheet or the like).

Further, symbols in the following description of the embodiment are used as having the following meanings.

R1: A line parallel to the array direction of the nozzles 18, which is an imaginary straight line on which the center of each alternate one of the nozzles 18 is located. A plurality of nozzles arrayed on the imaginary straight line R1 are referred to as a nozzle row R1.

R2: A line parallel to the array direction of the nozzles 18 (and to the imaginary straight line R1), which is an imaginary straight line on which the center of each alternate one of the nozzles 18 whose centerlines are not located on the imaginary straight line R1 is located. A plurality of nozzles arrayed on the imaginary straight line R2 are referred to as a nozzle row R2.

P: An interval between the centers of the nozzles in the array direction of the nozzles 18, which is a distance in the direction of the imaginary straight lines R1 and R2 between the nozzles 18 arranged on the imaginary straight line R1 and the nozzles 18 adjacent to the above nozzles 18 and arranged on the imaginary straight line R2 (nozzle pitch).

$\delta$: A distance between the imaginary straight lines R1 and R2, which is a distance with respect to the direction orthogonal to the imaginary straight lines R1 and R2 (inter-nozzle-row distance).

Q1: A pressure centerline of the heater elements 13 corresponding to the nozzles 18 on the imaginary straight line R1.

Note that it is different from a centroid line connecting the centroids of the heater elements 13.

Q2: A pressure centerline of the heater elements 13 corresponding to the nozzles 18 on the imaginary straight line R2. Note that it is different from a centroid line connecting the centroids of the heater elements 13.

δ': A distance between the pressure centerline Q1 and the pressure centerline Q2, which is a distance with respect to the direction orthogonal to the array direction of the nozzles 18 (imaginary straight lines R1 and R2).

H: A distance between the nozzle surface and the recording medium.

S1: A line connecting the centers of a row of dots formed by ink droplets ejected from the nozzles 18 on the imaginary straight line R1 side. A plurality of dots arrayed on the line S1 are referred to as a dot row S1.

S2: A line connecting the centers of a row of dots formed by ink droplets ejected from the nozzles 18 on the imaginary straight line R2 side. A plurality of dots arrayed on the line S2 are referred to as a dot row S2.

σ: A distance between the dot row S1 and the dot row S2, which is a distance with respect to the direction orthogonal to the array direction of the nozzles 18 (imaginary straight lines R1 and R2) (inter-dot-row distance).

α, β: An angle formed by the ejection direction when ink droplets are ejected from the nozzles 18 perpendicularly to the nozzle surface, and the ejection direction when the ink droplets are actually ejected from the nozzles 18.

hc: An amount of offset between the center of the nozzles 18 and the centroid of the heater elements 13, which is a distance with respect to the direction orthogonal to the array direction of the nozzles 18 (offset amount).

Dy: A distance between the center of a dot row that is formed when an ink droplet is ejected from each nozzle 18 perpendicularly to the nozzle surface and impacted on the recording medium, and the center of a dot row that is formed when an ink droplet is actually ejected from each nozzle 18 and impacted on the recording medium, which is a distance with respect to the direction orthogonal to the array direction of the nozzle rows (the array direction of the nozzles 18 or the direction of the imaginary straight lines R1 and R2) (deflection amount).

FIG. 1 is a partial perspective view showing the head 11 according to this embodiment.

As shown in FIG. 1, the head 11 has a barrier layer 16 laminated on a semiconductor substrate 15 serving as a substrate member 14, with a nozzle plate (nozzle sheet) 17 being bonded onto the barrier layer 16. Note that in FIG. 1, the nozzle plate 17 is shown in an exploded state for the convenience of description. Further, in the following description, the portion of the head 11 excluding the nozzle plate 17 is referred to as a head chip 19.

The semiconductor substrate 15 is made of silicon, glass, ceramics, or the like. Further, the heater elements 13 are formed through deposition (for example, by depositing a material forming the heater elements 13 by sputtering using plasma) on one surface (the upper surface in FIG. 1) of the semiconductor substrate 15 by the microprocessing technique used for the manufacture of semiconductors or electronic devices. The heater elements 13 are electrically connected to an external circuit through the intermediation of conductor portions (not shown) similarly formed on the semiconductor substrate 15 and via a drive circuit, a control logic circuit, and the like similarly formed in the inner portion thereof.

Further, the barrier layer 16 is formed on the heater element 13 side of the semiconductor substrate 15. The barrier layer 16 is formed from photosensitive resin by patterning in a portion excluding the peripheral portions of the heater elements 13. That is, the barrier layer 16 is made of, for example, a photosensitive cyclized rubber resist or a photo-setting dry film resist. The barrier layer 16 is formed by being laminated on the entire surface of the semiconductor substrate 15 on which the heater elements 13 are formed, and then removed of unnecessary portions by photolithography.

Further, the nozzle plate 17 is formed by an electrocasting technique using nickel (Ni), for example, so that the plurality of nozzles 18 are arrayed thereon. Further, the nozzle plate 17 is subjected to positioning so that the positions of the respective nozzles 18 on the nozzle plate 17 correspond to the positions of the respective heater elements 13 on the semiconductor substrate 15, before being bonded onto the barrier layer 16.

Further, the nozzles 18 are placed so as to be located on the two imaginary straight lines R1 and R2 (so that the center axes of the nozzles 18 are located on the imaginary straight lines R1 and R2) that are placed at a distance (row-to-row distance of the nozzles 18) 6 therebetween. Further, adjacent ones of the nozzles 18 are placed alternately on the imaginary straight lines R1 and R2. Further, the pitch (nozzle pitch) between the adjacent nozzles 18 in the direction of the imaginary straight lines R1 and R2 is set to P. Note that the array obtained by the alternate placement of the nozzles 18 on the imaginary straight lines R1 and R2 as described above is herein referred to as the "staggered array".

The ink chambers 12 are defined by the semiconductor substrate 15, the barrier layer 16, and the nozzle plate 17 so as to surround the respective heater elements 13. That is, the semiconductor substrate 15 and each heater element 13 form the top wall of each ink liquid chamber 12, the barrier layer 16 forms the three side walls of each ink liquid chamber 12, and the nozzle plate 17 forms the bottom wall of each ink liquid chamber 12. Note that in FIG. 1, the vertical positional relation of the heads 11 is reversed in order to clarify the positional relation between the respective heater elements 13 and the respective nozzles 18.

Each of the ink liquid chambers 12 has an opening region provided in the lower right in FIG. 1. The opening region communicates with a common ink passage. Accordingly, ink in an ink tank (not shown) passes through the common ink passage to be supplied from the respective opening regions into the respective ink liquid chambers 12.

Note that the portion including each ink liquid chamber 12, heater element 13, and nozzle 18 described above is herein referred to as the "liquid ejecting portion". That is, the head 11 includes a plurality of arrays of liquid ejecting portions.

Figure 2:
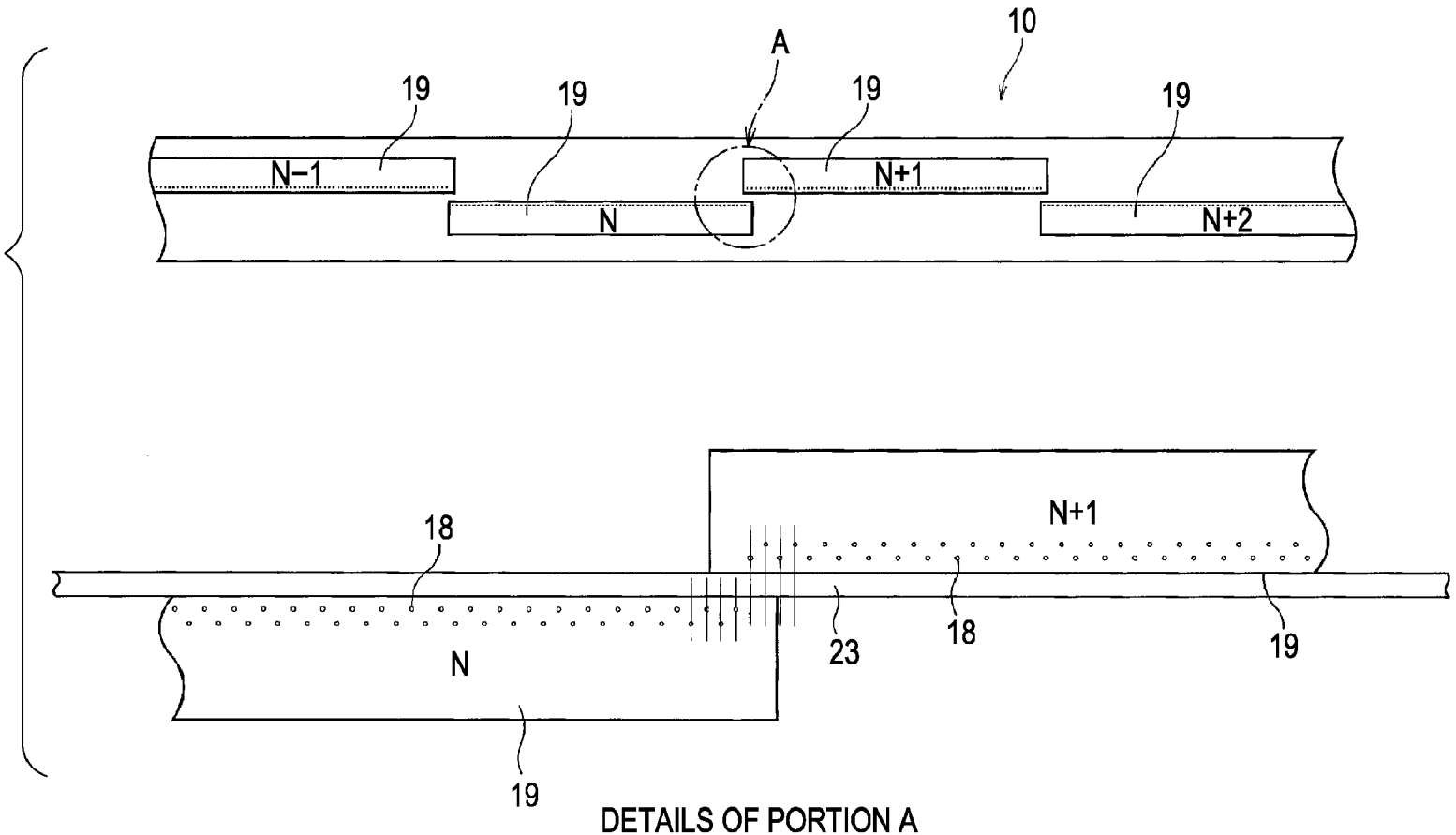
FIG. 2 is a plan view showing a line head according to the embodiment of the present invention.

FIG. 2 is a plan view showing a line head 10 according to this embodiment.

A line head 10 shown in FIG. 2 has four heads 11 ("N−1", "N", "N+1", and "N+2"). The heads 11 are provided side by side. The line head 10 shown in FIG. 2 is formed by providing a plurality of the head chips 19 side by side and bonding thereto a single nozzle plate 17 having the plurality of nozzles 18 formed therein.

Further, in the line head 10, the respective nozzles 18, including the nozzles 18 at the end portions of adjacent heads 11, are arranged at the same pitch P. That is, as shown in the detailed illustration of the portion A, the nozzles 11 are placed such that the pitch P between the nozzle 18 at the right end portion of the N-th head 11 and the nozzle 18 at the left end portion of the (N+1)-th head 11 becomes equal to the pitch P between the nozzles 18 in each head 11.

Further, by arranging the required number of the line heads 10 in the direction orthogonal to the array direction of the nozzles 18 to form head rows, and supplying ink of different colors to each of the head rows, it becomes possible to handle color printing. For example, when the head rows include 4 rows of Y (yellow), M (magenta), C (cyan), and K (black), an inkjet printer capable of color printing can be obtained.

Figure 12:
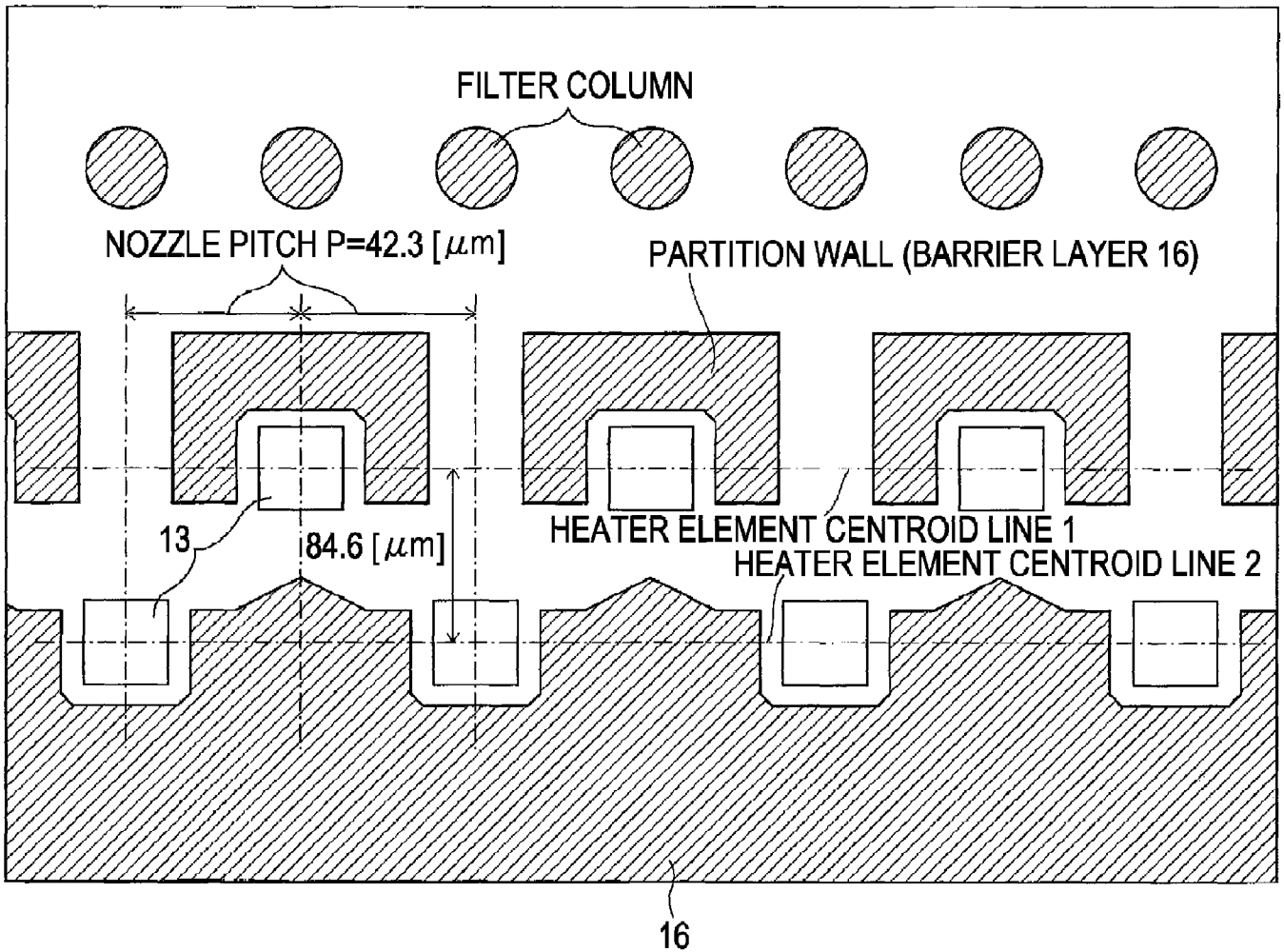
FIG. 12 is a view showing a line inkjet printer according to EXAMPLE.

By supplying ink of the respective colors to the ink tanks (not shown) of four colors connected to the respective head 11 rows, when ink is filled in the ink liquid chambers 12 shown in FIG. 12, and then a pulse current is supplied to each of the heater elements 13 for a short period of time (for example, 1 to 3 μsec) based on the print data, the heater elements 13 are rapidly heated, thereby allowing the ink at the portion in contact with the heater elements 13 to generate bubbles due to film boiling. Thus, a predetermined volume of ink is pushed away due to expansion of the bubbles. Ink of a volume equal to the volume of the ink thus pushed away is ejected in the form of droplets from the nozzles 18 and impacted on the recording medium, thus forming a dot row. An image is formed by forming a large number of these dot rows.

Next, the ejection direction of ink droplets will be described.

Figure 3A:
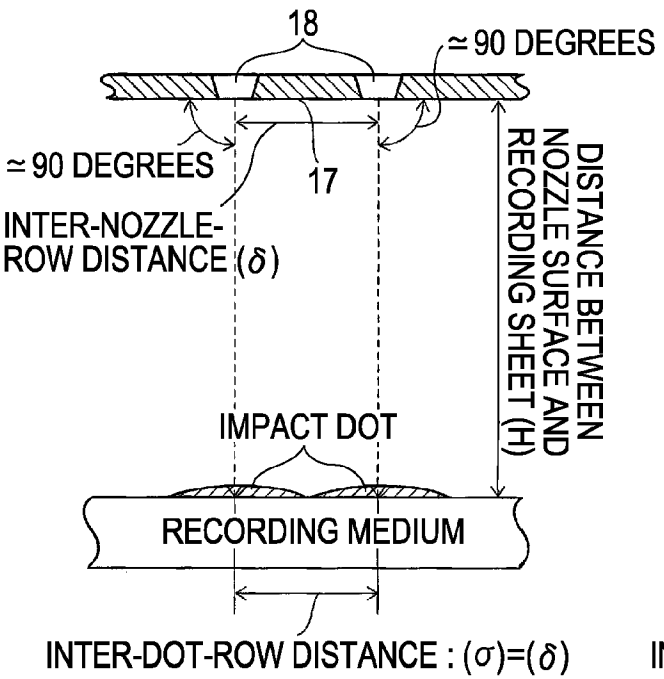
FIGS. 3A is a view showing the ejection direction of ink droplets in the related art.
Figure 3B:
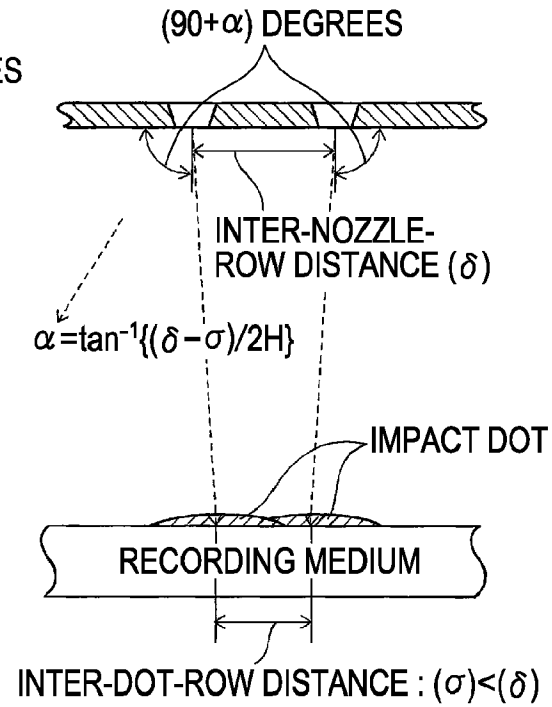
FIGS. 3B and 3C are views showing the ejection direction of ink droplets according to the embodiment of the present invention, as opposed to the ejection direction in the related art.
Figure 3C:
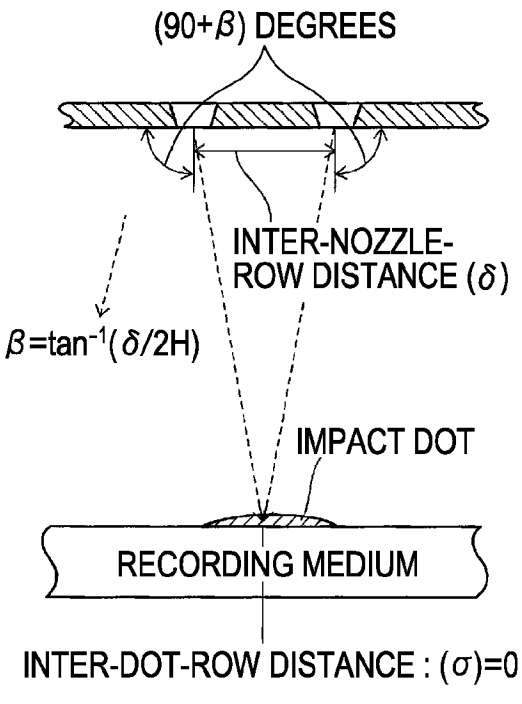

FIGS. 3A to 3C are views illustrating a comparison between the ejection direction of ink droplets in the related art (FIG. 3A) and the ejection direction of ink droplets (FIGS. 3B and 3C) according to this embodiment.

FIGS. 3A to 3C are views, as seen from the side, showing how ink droplets ejected from the nozzles 18 are impacted on the recording medium in the case of the head 11 having a staggered array, with the nozzle plate 17 being depicted at the top and the recording medium at the bottom.

Figure 22B:
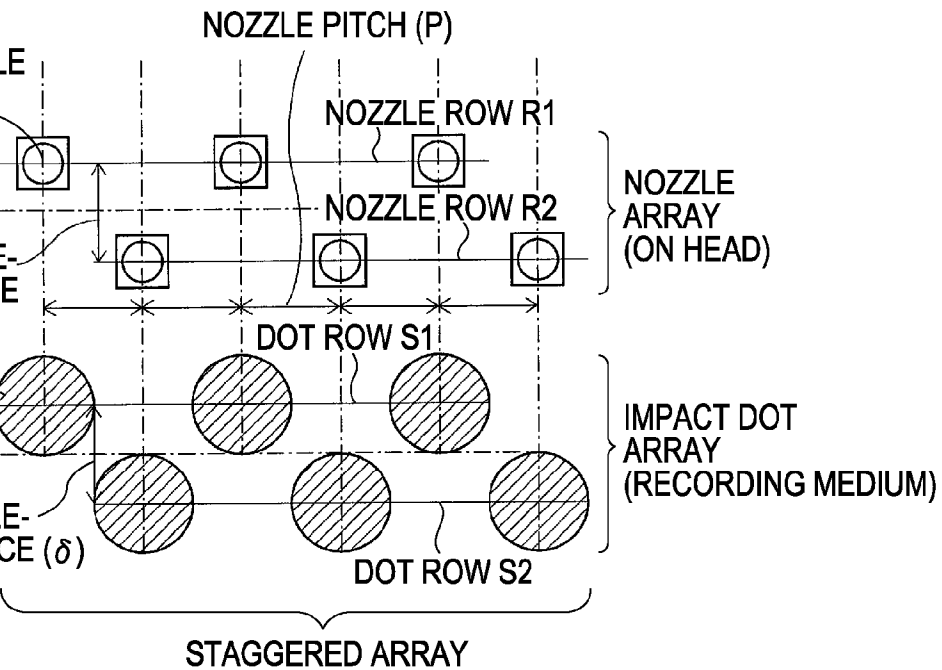
FIG. 22B is a view showing a case where the nozzles are arrayed in a staggered manner.
Figure 22A:
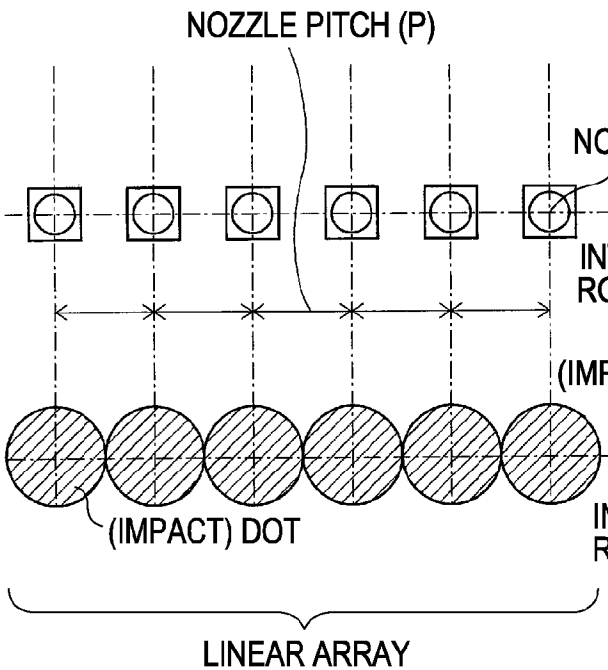
FIG. 22A is a view showing a case where the nozzles are arrayed in a straight line.
Figure 23A:
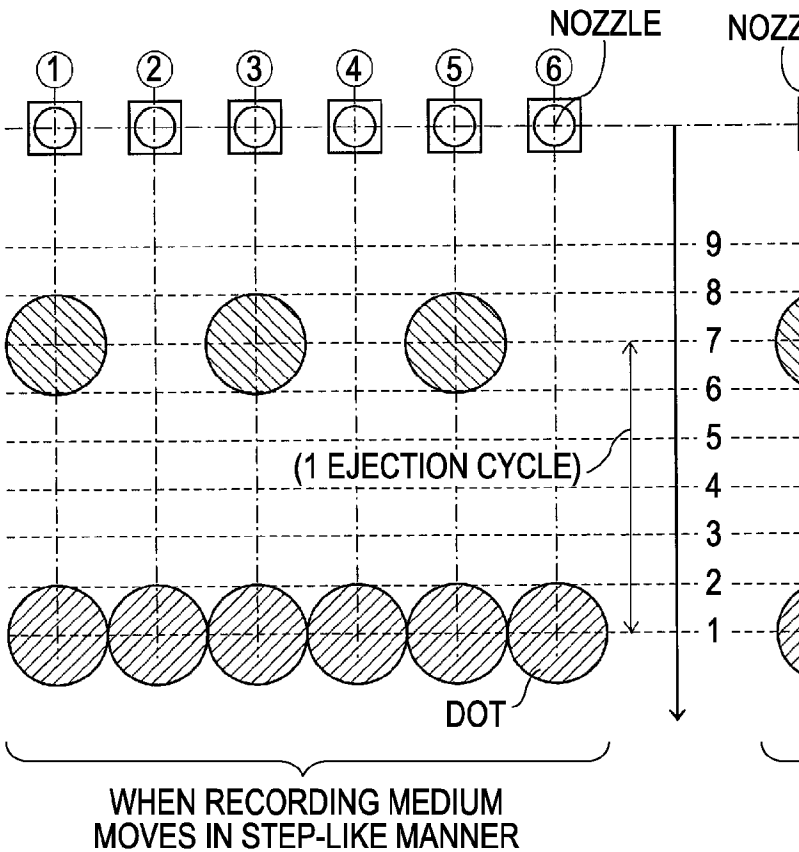
Figure 23B:
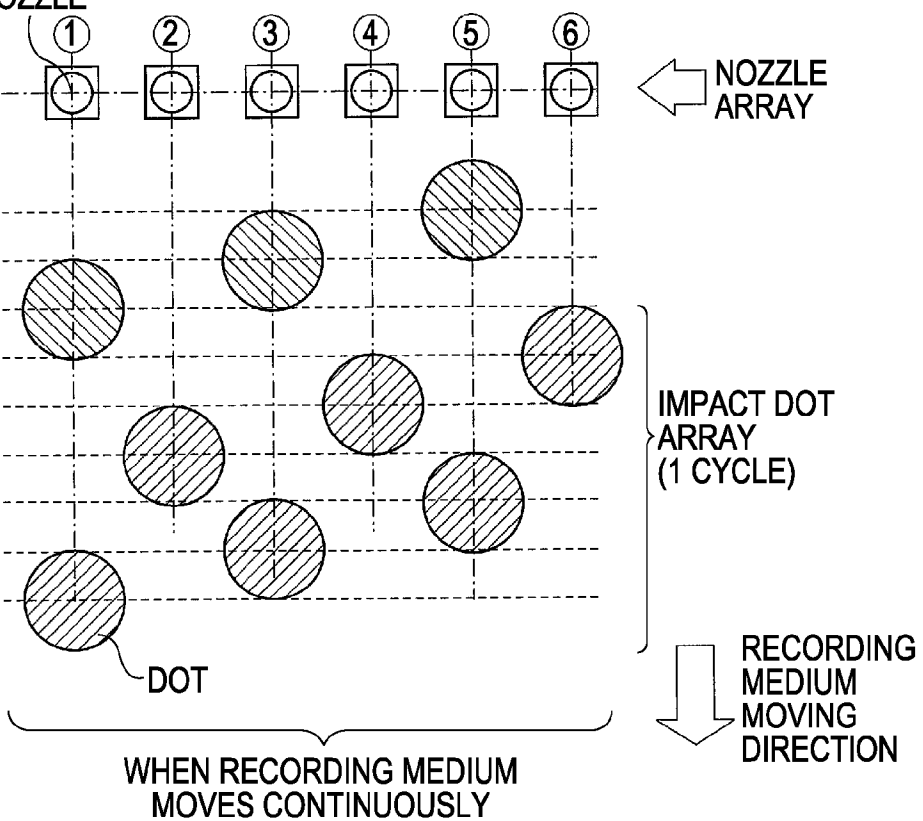

FIG. 3A shows a case in which ink droplets are ejected from the nozzles 18 along the normal to the surface of the nozzle plate (nozzle surface). In this case, since the inter-dot-row distance σ=inter-nozzle-row distance δ, the dot rows formed on the recording medium are as shown at the bottom of FIG. 22B as seen from the nozzle surface side.

In contrast, FIG. 3B shows a general case according to this embodiment. When the ejection direction of ink droplets ejected from the nozzles 18 of the alternate rows is deflected by some means so that the inter-dot-row distance σ becomes smaller than the inter-nozzle-row distance δ, the dot arrays are made less visually conspicuous as compared with the case of FIG. 3A, for example.

Further, FIG. 3C shows a special case according to this embodiment in which the ejection direction of ink droplets is adjusted so that the inter-dot-row distance σ=0, that is, the dots formed on the recording medium are arrayed along one straight line even through the nozzle rows are in a staggered array.

As described above, in the related art, the method considered to provide favorable recording results is to eject ink droplets at an angle as close to a right angle as possible with respect to the nozzle surface, that is, straight along the normal to the nozzle surface (this can be appreciated also from Patent No. 2720989 and Japanese Patent Application No. 2000-110056 according to the related art).

In contrast, according to this embodiment, the ejection direction of ink droplets is adjusted by intentionally deflecting the ejection direction from the direction of the normal so that the dot array formed on the recording medium become a desired one.

Further, in the case where the arraying of the nozzles 18 and the distance H between the nozzle surface and the recording medium are determined, upon determining the dot array to be obtained, the ejection direction of ink droplets in the direction orthogonal to the arrangement direction of the nozzles 18 is uniquely determined for each of the nozzles 18. The following provides a calculation of the ejection angle of ink droplets that is to be actually determined.

First, referring to FIG. 3C, the case of a practical inkjet printer is considered. In this case, for example, the distance H between the recording medium and the nozzle surface is 2.0 (mm), and the nozzle pitch P is 42.3 (μm) at 600 DPI. Further, it is assumed that the inter-nozzle-row distance δ is also 42.3 (μm). At this time, when the ejection angle of ink droplets is "90+β" degrees, then $$\beta=\tan^{-1}(\delta/2H)=\tan^{-1}(42.3/4000)=0.010575(\text{rad})$$
$$=0.60588\ (\text{degree}).$$

In the case of a thermal system, for example, a deflection by an angle of this degree can be realized by slightly shifting the center of the nozzles 18 and the center of the heater elements 13 in the direction orthogonal to the array direction of the nozzles 18.

Next, the influence of the relative movement between the head 11 and the recording medium will be described.

The head 11 and the recording medium move relative to each other. In this regard, according to this embodiment, in particular, the head 11 remains stationary while the recording medium is conveyed, whereby the head 11 and the recording medium make relative movement.

Taking this relative movement into account, in order that the centers of the dots are arranged in a straight line on the recording medium within the margin of error, it is necessary to shift the nozzle 18 array in advance by taking the ejection order of ink droplets into account.

However, when the distance over which the head 11 and the recording medium move relative to each other is sufficiently small relative to the inter-nozzle-row distance δ, the relative movement between the head 11 and the recording medium becomes so small as to be negligible.

Further, in this embodiment, when the dot rows are formed, the distance σ between two (approximate) lines, which pass through the respective centers of the dot row formed when ink droplets are ejected from alternate nozzles 18, that is, from the nozzles 18 on one of the two imaginary straight lines R1 and R2, and the dot row formed when ink droplets are ejected from the nozzles 18 on the other imaginary straight line, and the distance δ between the imaginary straight lines R1 and R2 satisfy the relationship of σ<δ.

Next, a description will be given of how to deflect the ejection direction (the method for shifting at least one of the ejection direction of the nozzles 18 located on the imaginary straight line R1 and the ejection direction of the nozzles 18 located on the imaginary straight line R2 to the other imaginary straight line side).

Figure 4A:
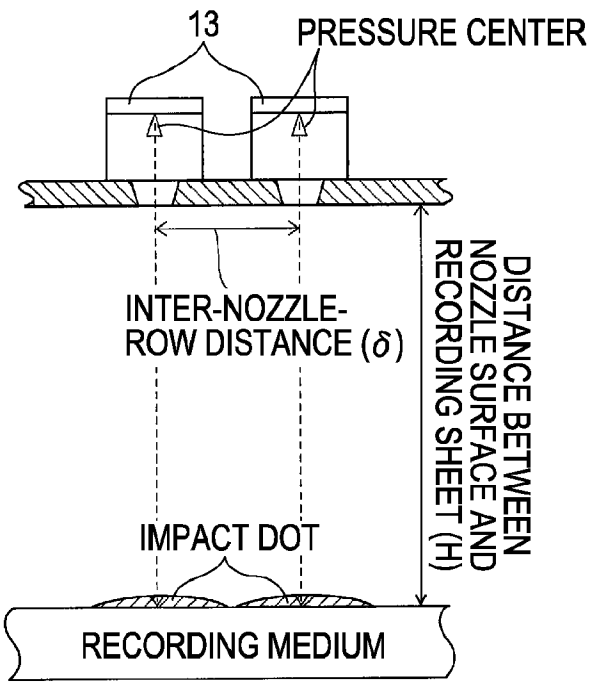
FIG. 4A is a view showing a case where the ejection direction of ink droplets is not deflected.
Figure 4B:
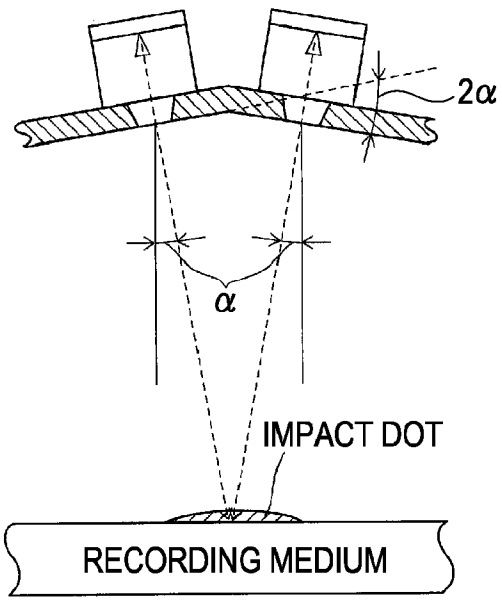
FIGS. 4B and 4C are views each showing a case where the ejection direction of ink droplets is deflected.
Figure 4C:
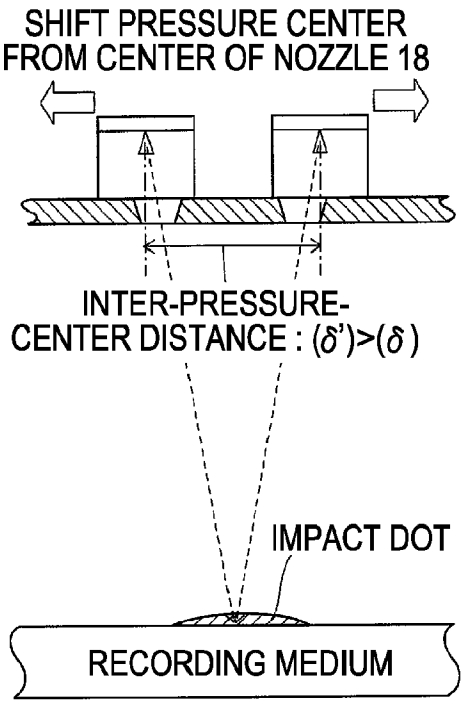

FIGS. 4A to 4C are views illustrating a case where the ejection direction of ink droplets is not deflected (FIG. 4A), and two conceivable methods for deflecting the ejection direction of ink droplets (FIGS. 4B and 4C).

Herein, the word "pressure center" in FIGS. 4A to 4C refers to a point where, when each heater element 13 is activated and a pressure acting to push ink droplets out of the nozzles is exerted, the pressure component that is in parallel to the nozzle surface is zero, and a pressure is generated only in the direction for pressurizing the nozzle surface. In other words, the pressure center refers to a point on each heater element 13 allowing the ink droplet to be ejected straight along the normal to the nozzle surface, that is, a point where the pressure vector on the heater element 13 coincides with the direction of the normal to the surface of the heater element 13.

First, FIG. 4A shows the case where the ejection direction of ink droplets is not deflected. In this case, the row-to-row distance δ between the nozzles 18 on the imaginary straight line R1 side and the nozzles 18 on the imaginary straight line R2 side is equal to the distance σ between the centers of the dot rows formed.

In contrast, in the example of FIG. 4B, the nozzle plate 17 is bent along an imaginary straight line located at the middle between the imaginary straight line R1 and the imaginary straight line R2, an ink droplet ejected from the nozzle 18 on the imaginary straight line R1 side is deflected by an angle α to the imaginary straight line R2 side, and likewise, on the opposite side, an ink droplet ejected from the nozzle 18 on the imaginary straight line R2 side is deflected by the angle α to the imaginary straight line R1 side. Further, the formed dot row is made to align on one imaginary straight line (the line obtained by projecting the imaginary straight line located at the middle between the imaginary straight line R1 and the imaginary straight line R2 onto the recording medium).

However, considering, for example, the assembling of precision apparatus or the semiconductor process, in general, the nozzle plate 17 can be formed only in a planar configuration. In reality, it may be practically impossible to realize the processing of the nozzle plate 17 as shown in FIG. 4B.

Further, FIG. 4C shows a case where the line connecting the pressure centers of the heater elements 13 corresponding to the respective nozzles 18 arrayed on the imaginary straight line R1 is shifted in the direction away from the imaginary straight line R2 (the direction indicated by the arrows in the drawing). Likewise, the line connecting the pressure centers of the heater elements 13 corresponding to the respective nozzles 18 arrayed on the imaginary straight line R2 is shifted in the direction away from the imaginary straight line R1 (the direction indicated by the arrows in the drawing).

That is, a construction is adopted in which the distance δ' between the line Q1, which connects the pressure centers of the heater elements 13 in the liquid ejecting portions arrayed on the imaginary straight line R1 side, and a line Q2, which connects the pressure centers of the heater elements 13 in the liquid ejecting portions arrayed on the imaginary straight line R2 side, becomes larger than the row-to-row distance δ between the nozzles 18.

With this construction, the dot row formed by ink droplets ejected from the liquid ejecting portions on the imaginary straight line R1 side, and the dot row formed by ink droplets ejected from the liquid ejecting portions on the imaginary straight line R2 side can be both aligned on one imaginary straight line.

Next, the specific structure of the liquid ejecting portion will be described.

Figure 5B:
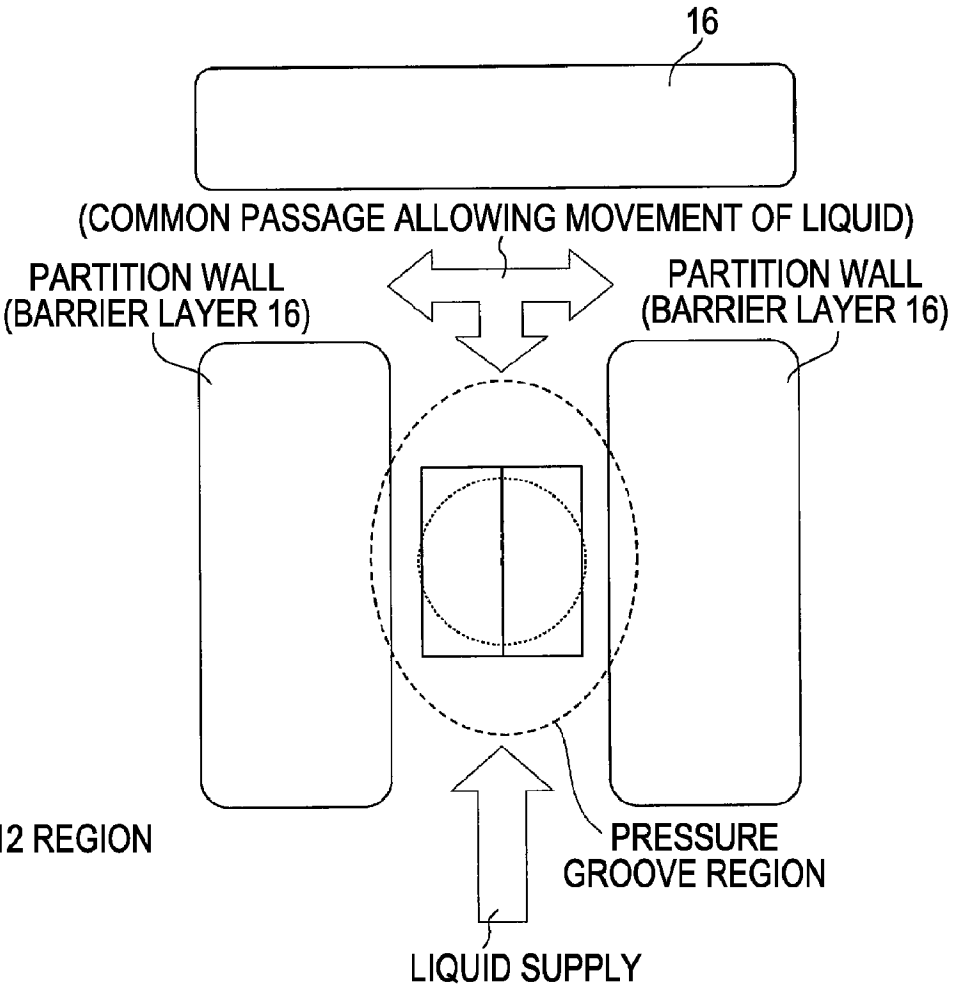
FIGS. 5A and 5B are views each showing the configurations of a heater element, nozzle, and barrier layer.
Figure 5A:
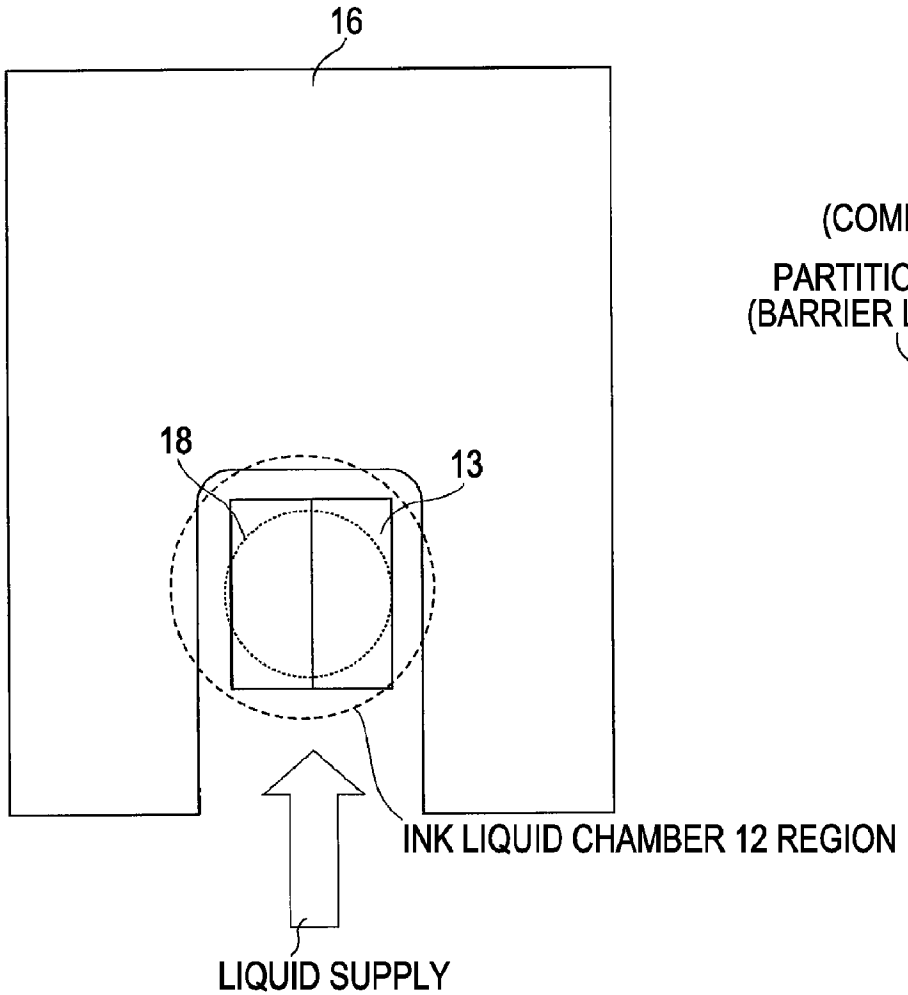

FIGS. 5A and 5B are views each illustrating the configurations of each heater element 13, nozzle 18, and barrier layer 16.

Of FIGS. 5A and 5B, FIG. 5A shows a structure of the ink liquid chamber 12 (shown in FIG. 1) in which the three peripheral sides of the heating element 13 are blocked by the barrier layer 16 and only one side thereof is open. A liquid is supplied into the ink liquid chamber 12 from the opening side thereof. According to this structure, since only one side is open, the ejection pressure and hence the ejection speed are high.

Note that in this case, the pressure center shifts to the rear side with respect to the centroid (geometrical center) of the heater element 13.

Further, of FIGS. 5A and 5B, FIG. 5B shows a structure in which partition walls (barrier layers 16) are each provided between adjacent heater elements 13. Accordingly, the partition walls are provided on both sides with respect to the arrangement direction of each heater element 13 so as to be opposed to each other with the heater element 13 therebetween. Thus, unlike in FIG. 5A, according to the structure of this system, the three sides of the heater element 13 are not surrounded (pressure groove system).

Further, with this structure, the pressure at the time of bubble generation on the heater element 13 itself becomes lower as compared with that in the case of FIG. 5A, and further, unlike in FIG. 5A, there is hardly any shift in the pressure center on the heater element 13 and, in principle, the centroid of the heater element 13 presumably coincides with the pressure center. Further, presumably, when the normal to the nozzle surface passing through the pressure center of the heater element 13 is made to pass through the center of the nozzle 18, the probability of an ink droplet being ejected along the normal becomes the highest.

Further, the following three methods can be used to realize a staggered array for a thermal system by using the respective structures of the liquid ejecting portion shown in FIGS. 5A and 5B. These methods will be described in the following.

Figures 6A, 6B:
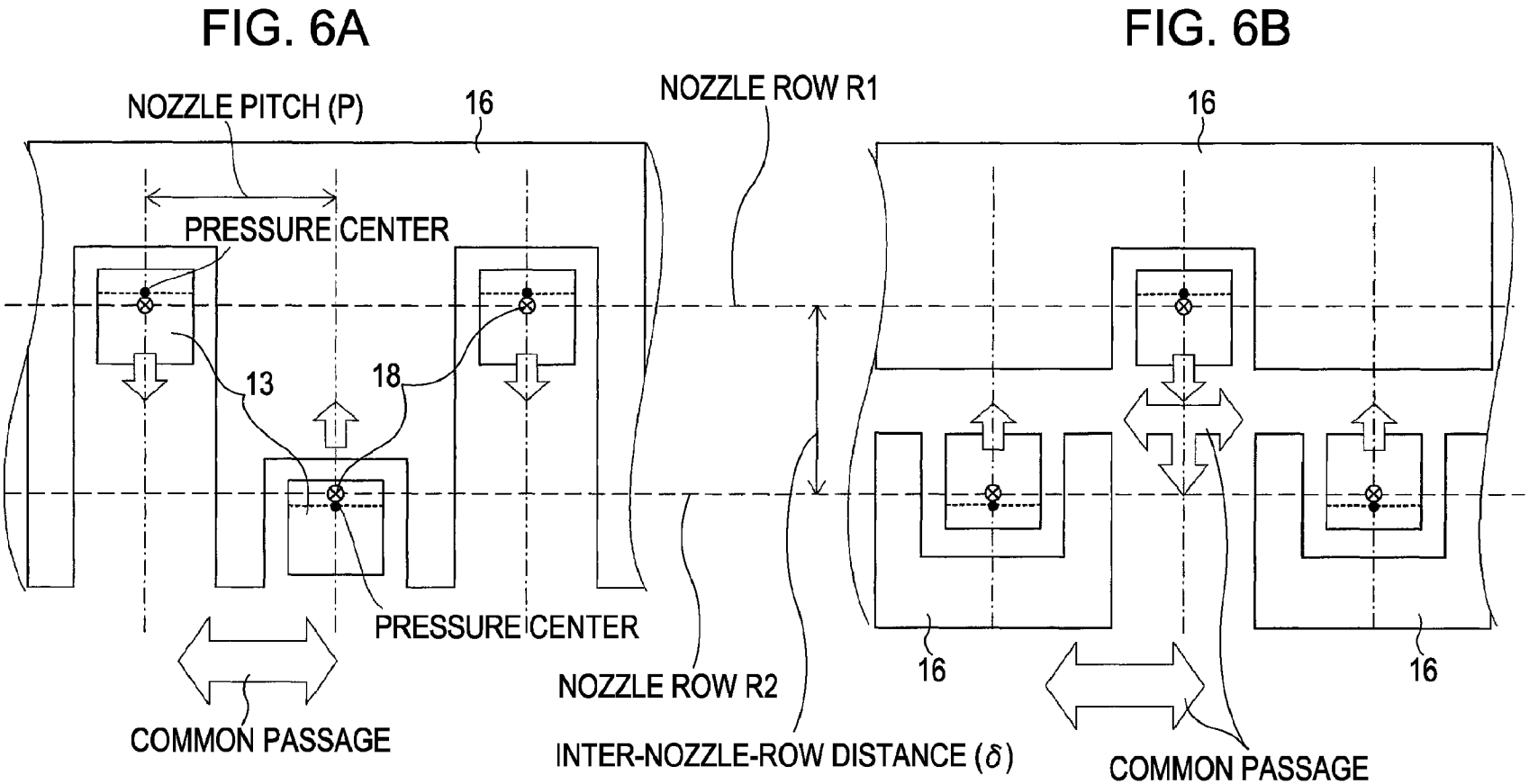
FIGS. 6A and 6B are views each showing a case of an array to which the structure of an ink liquid chamber shown in FIG. 5A is applied.

FIGS. 6A and 6B are views each illustrating an array to which the structure of the ink liquid chamber 12 shown in FIG. 5A is applied.

In FIG. 6A, the respective ink liquid chambers 12 are arranged so that their openings are oriented in the same direction, and their positions relative to the common passage are alternately shifted along the arrangement of the nozzles 18 by the inter-nozzle-row distance δ (alignment type). In FIGS. 6A and 6B, the "pressure center" as described above is also shown. Note that the offset amount illustrated in the drawing does not correspond to the actual offset amount.

In the example of FIG. 6A, an ink droplet must be ejected in the direction of the arrow from each ink liquid chamber 12. Thus, in FIG. 6A, in the case of ejection from each nozzle 18 on the nozzle row R1, the pressure center is located above the center of the nozzle 18, and in the case of ejection from each nozzle 18 on the nozzle row R2, the pressure center is located below the center of the nozzle 18. Accordingly, the directions of ejection of ink droplets from the nozzles 18 arranged on the nozzle rows R1 and R2 can each be made inwardly oriented.

In contrast, in the structure shown in FIG. 6B, the opening portion of the ink liquid chamber 12 located on the nozzle row R1 and the opening portion of the ink liquid chamber 12 located on the nozzle row R2 are opposed to each other (opposed type).

With this structure, when considering only the inner portions of the ink liquid chambers 12, ink liquid chambers 12 of the same structure are simply arranged in different orientations. Thus, advantageously, it suffices that ink liquid chambers 12 that are identical in terms of the relation between the rear wall, pressure center, and the nozzle 18 be placed in opposite orientations.

Although both the systems shown in FIGS. 6A and 6B are the same in that the pressure center point is located on the outside of the region surrounded by the two nozzle rows R1 and R2, in the structure shown in FIG. 6B, the rear wall of each of the ink liquid chambers 12 is located outside of the region surrounded by the two nozzle rows R1 and R2. As a result, as seen from the pressure center of each heater element 13, large portions of the respective heater elements 13 face each other inwardly with respect to the nozzle rows R1 and R2; thus, provided that the inter-nozzle-row distance δ is the same, the distance between the heater elements 13 becomes accordingly smaller as compared with the alignment type structure.

Further, a case can be conceived in which the structure of FIG. 5B is applied to a staggered array of the nozzles 18.

Figure 7:
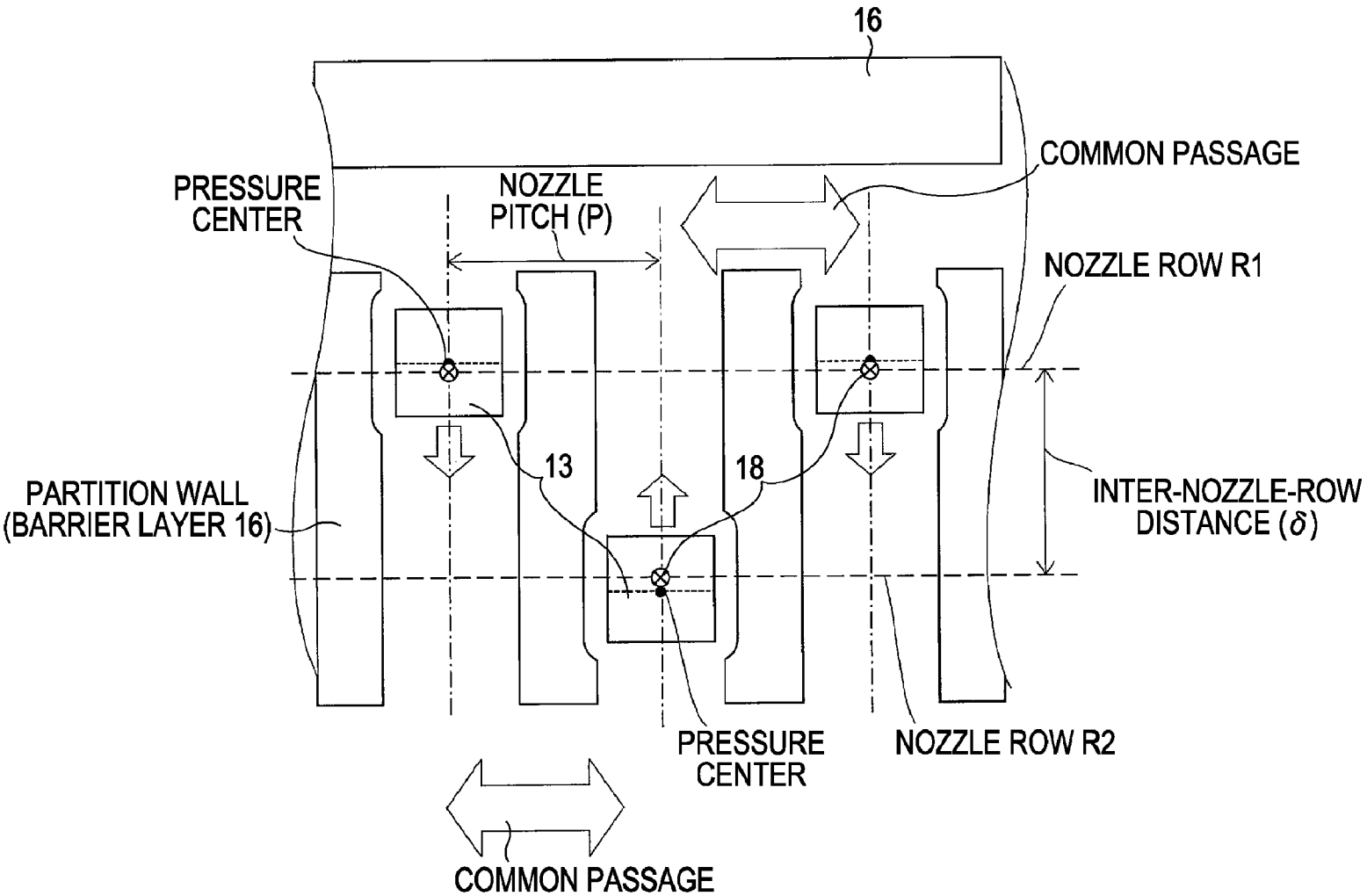
FIG. 7 is a plan view showing the structure of FIG. 5B as applied to a staggered array.

FIG. 7 is a plan view showing the structure of FIG. 5B as applied to the staggered array.

The major difference from the system of the ink liquid chamber 12 as described above resides in that the centroid and pressure center of each heater element 13 are substantially the same in the pressure groove system.

Accordingly, when the pressure centers are placed along the nozzle rows R1 and R2, while the positional relation between the pressure centers and the nozzles 18 is similar to that of the opposed type (FIG. 6B), provided that the inter-nozzle-row distance δ is the same, the distance δ' between the pressure centers of the heater elements 13 becomes narrower in the pressure groove system than that in the structure shown in FIGS. 6A and 6B.

As described above, even in the case of the thermal system of the staggered array with the constant inter-nozzle-row distance δ, the pressure centers on the heater elements 13 vary according to the ejection system employed, so the placement of the heater elements 13, the positional relation between the centroids of the heater elements 13 and the centers of the nozzles 18, and the like varies.

Further, examples of dot rows formed by ink droplets impacting on the recording medium mainly include the following two arrangements.

Figures 8A, 8B:
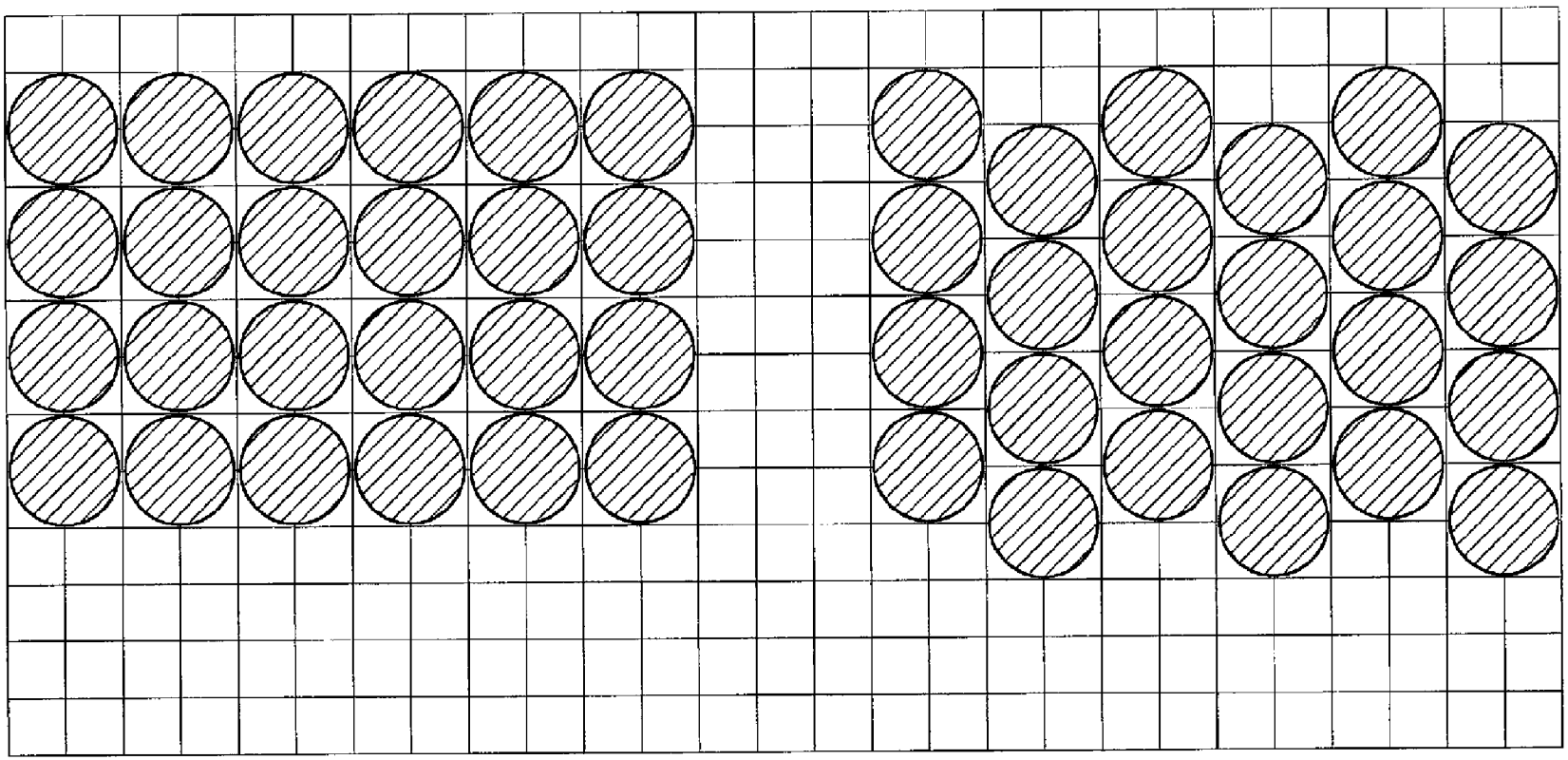
FIGS. 8A and 8B are plan views each showing respective dot rows.

FIGS. 8A and 8B are plan views each showing dot rows. Note that in FIG. 8, the horizontal direction represents the arrangement direction of the nozzles 18, and the vertical direction represents the direction of relative movement between the head 11 and the recording medium.

When recording is successively performed with the relative speed between the head 11 and the recording medium being made to coincide with one ejection cycle, the inter-dot-row distance σ becomes zero, so the dot rows are aligned substantially on one straight line. FIG. 8A shows this case (tetragonal lattice array).

In contrast, FIG. 8B shows a case in which the inter-dot-row distance σ is set to ½ of the dot pitch P (staggered array).

Incidentally, the present invention is directed to controlling the direction in which ink droplets are ejected in the direction orthogonal to the arrangement direction of the nozzles 18 so that the inter-dot-row distance σ becomes smaller than the inter-nozzle-row distance δ.

In this regard, by using the techniques (for example, Japanese Unexamined Patent Application Publication No. 2004-1364, Japanese Unexamined Patent Application Publication No. 2004-58649, J Japanese Unexamined Patent Application Publication No. 2004-136628, or the like) previously proposed by the applicant of the present invention, the present invention can be combined with the technique for controlling the ejection direction of ink droplets with respect to the arrangement direction of the nozzles 18.

Now, an embodiment of such a structure will be described.

First, each one liquid ejecting portion is provided with, for example, two (half-split) heater elements 13. Further, the arrangement direction of the two heater elements 13 corresponds to the array direction of the nozzles 18. Note that in the structure shown in FIG. 1, two heater elements 13 are arranged in parallel inside each one ink liquid chamber 12.

Further, the word "half-split" means not only the case where the two heater elements 13 are physically completely separated from each other but also the case where the two heater elements 13 are partially connected to each other. For examples, each of the two heater elements 13 has a substantially recessed configuration as seen in plan view; by providing electrodes in each of the both distal end portions and central return (inflected) portion of the substantially recessed configuration, the two heater elements 13 substantially exhibits a configuration as if split in two.

Further, in the case where the half-split heater elements 13 are provided inside each one ink liquid chamber 12, the times it takes for the respective heater elements 13 to reach the temperature for boiling the ink (bubble generation time) are normally set to be the same. When a difference occurs in bubble generation time between the two heater elements, the ejection angle of ink droplets does not become perpendicular, with the result that the ejection direction of ink droplets is deflected and the impact positions of the ink droplets are shifted from the perpendicular positions.

In view of this, by taking advantage of this characteristics, by connecting the two heater elements 13 in series, and making a current flow into and out of the midpoint (junction portion) therebetween to thereby change the balance of currents flowing in the heater elements 13, a control is performed so that a difference occurs between the bubble generation times on the two heater elements (so that bubbles are generated at different times), thereby deflecting the ejection direction of ink droplets to the arrangement direction of the nozzles 18.

Further, when, for example, the resistances of the half-split heater elements 13 are not the same due to a manufacturing error or the like, a difference in bubble generation time occurs between the two heater elements 13, with the result that the ejection direction of ink droplets does not become perpendicular and the impact positions of the ink droplets deviate from the original positions. However, when the time at which bubbles are generated on each heater element 13 is controlled by varying the amounts of current passed through the half-split heater elements 13 to thereby make the two heater elements 13 generate bubbles at the same time, the ejection direction of ink droplets can be made perpendicular.

For instance, in the line head 10, by deflecting the ejection direction of ink droplets from specific one or two or more heads 11 as a whole with respect to the original ejection direction, it is possible to correct the ejection direction from those heads 11 from which ink droplets are not ejected perpendicularly to the impacting surface of the recording medium due to a manufacturing error or the like, whereby the ink droplets can be ejected perpendicularly.

Further, another conceivable method includes deflecting the ejection direction of ink droplets from only specific one or two or more liquid ejecting portions in each one head 11. For example, when, in one head 11, the ejection direction of an ink droplet from a specific liquid ejecting portion is not parallel to the ejection direction of ink droplets from other liquid ejecting portions, only the ejection direction of the ink droplet from that specific liquid ejecting portion is deflected, thereby adjusting the ejection direction so as to be parallel to the ejection direction of the ink droplets from the other liquid ejecting portions.

Further, the ejection direction of ink droplets can be deflected as follows.

For example, in the case where an ink droplet is to be ejected from a liquid ejecting portion "E" and a liquid ejecting portion "E+1" that are adjacent to each other, the impact positions when ink droplets are ejected without undergoing deflection from the liquid ejecting portion "E" and the liquid ejecting portion "E+1" are set as an impact position "e" and an impact position "e+1", respectively. In this case, the ink droplet can be ejected from the liquid ejecting portion "E" without undergoing deflection to be impacted on the impact position "e", or the ink droplet can be impacted on the impact position "e+1" by deflecting the ejection direction of the ink droplet.

Likewise, the ink droplet can be ejected from the liquid ejecting portion "E+1" without undergoing deflection to be impacted on the impact position "e+1", or the ink droplet can be impacted on the impact position "e" by deflecting the ejection direction of the ink droplet.

In this regard, when, for example, clogging or the like occurs in the liquid ejecting portion "E+1" so that it is difficult to eject the ink droplet from the liquid ejecting portion "E+1", it may normally be impossible to impact ink on the impact position "e+1". Thus, dot chipping occurs and the head 11 becomes deflective.

In such a case, however, ink is ejected from another liquid ejecting portion, such as from the liquid ejecting portion "E" adjacent to the liquid ejecting portion "E+1" or from a liquid ejecting portion "E+2", thereby making it possible to impact the ink droplet on the impact position "e+1".

Figure 9:
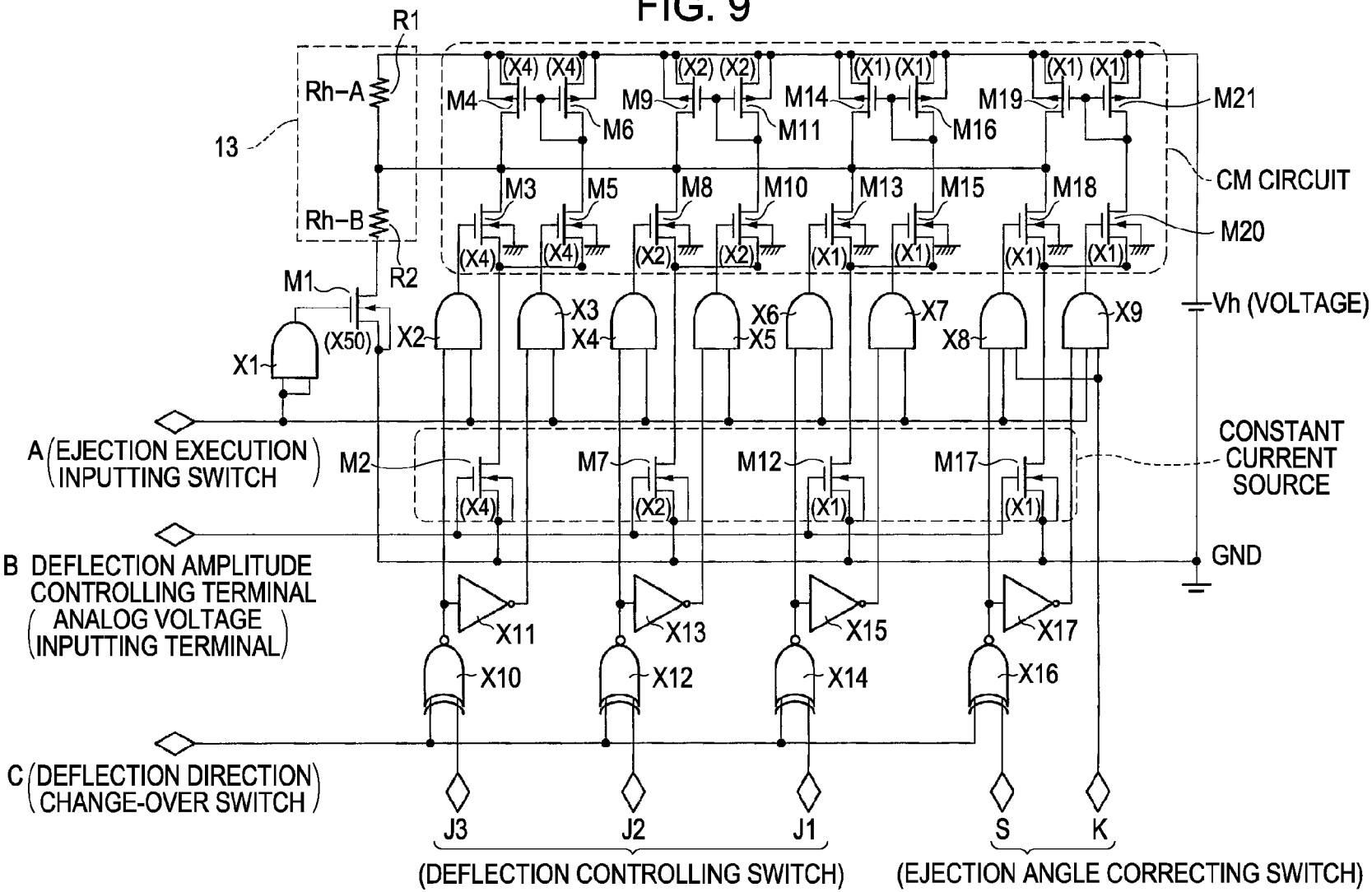
FIG. 9 is a diagram showing a circuit that embodies means for deflecting the ejection direction of ink droplets.

FIG. 9 is a diagram showing a circuit that embodies means for deflecting the ejection direction of ink droplets. First, elements used in this circuit and the connecting state therebetween will be described.

In FIG. 9, resistors Rh-A and Rh-B, which represent the half-split heater elements 13 described above, are connected in series. A power source Vh is a power source for flowing a current through each of the resistors Rh-A and Rh-B.

The circuit shown in FIG. 9 includes transistors M1 to M21. The transistors M4, M6, M9, M11, M14, M16, M19, and M21 are CMOS transistors, and the other transistors are NMOS transistors. In the circuit shown in FIG. 9, the transistors M2, M3, M4, M5, and M6 form a current mirror circuit (hereinafter, referred to as the "CM circuit"), and there are provided four CM circuits in total.

In this circuit, the gate and drain of the transistor M6 and the gate of the transistor M4 are connected to each other. Further, the drains of the transistors M4 and M3 are connected to each other, and the drains of the transistors M6 and M5 are connected to each other. The same applies to the other CM circuits.

Further, the drains of the transistors M4, M9, M14, and M19, and of the transistors M3, M8, M13, and M18, each constituting a part of the CM circuit, are connected to the midpoint between the resistors Rh-A and Rh-B.

Further, the transistors M2, M7, M12 and M17 each serve as a constant current source for each of the CM circuits. The drains thereof are connected to the sources of the transistors M3, M5, MM8, M10, M13, M15, M18, and M20, respectively.

Furthermore, the drain of the transistor M1 is connected in series to the resistor Rh-B. The transistor M1 is turned ON when an ejection execution inputting switch A becomes "1" (ON), and causes a current to flow to each of the resistors Rh-A and Rh-B.

Further, the output terminals of AND gates X1 to X9 are connected to the gates of the transistors M1, M3, M5, etc., respectively. Note that while the AND gates X1 to X7 are of a two-input type, the AND gates X8 and X9 are of a three-input type. At least one of the input terminals of the AND gates X1 to X9 is connected with the ejection execution inputting switch A.

Furthermore, of each of XNOR gates X10, X12, X14, and X16, one input terminal thereof is connected to a deflection direction change-over switch C, and the other input terminal thereof is connected to deflection controlling switches J1 to J3 or an ejection angle correcting switch S.

The deflection direction change-over switch C is a switch for changing over the side to which the ejection direction of ink droplets is deflected with respect to the arrangement direction of the nozzles 18. When the deflection direction change-over switch C becomes "1" (ON), one input of the XNOR gate X10 becomes "1".

Further, the deflection controlling switches J1 to J3 are each a switch for determining the deflection amount by which the ejection direction of ink droplets is to be deflected. When, for example, the input terminal J3 becomes "1" (ON), one input of the XNOR gate X10 becomes "1".

Further, the respective output terminals of the XNOR gates X10 to X16 are connected to one input terminals of the AND gates X2, X4, etc., and are connected to one input terminals of the AND gates X3, X5, etc. via NOT gates X1, X13, etc. Further, one input terminal of each of the AND gates X8 and X9 is connected with an ejection direction correcting switch K.

Furthermore, a deflection amplitude controlling terminal B is a terminal for determining the amplitude of one deflection step. The deflection amplitude controlling terminal B determines the current values of the transistors M2, M7, etc., each serving as the constant current source for each CM circuit, and is connected to the respective gates of the transistors M2, M7, etc. The deflection amplitude can be made 0 as follows. That is, when this terminal is set to 0 V, the current of each current source becomes 0. Thus, no deflection current flows and the amplitude can be made 0. When this voltage is gradually increased, the current value gradually increases, thus allowing a large amount of deflection current to flow to thereby increase the deflection amplitude.

That is, the deflection amplitude can be appropriately controlled on the basis of the voltage applied to this terminal.

Further, the source of the transistor M1 connected to the resistor Rh-B, and the sources of the transistors M2, M7, etc. each serving as the constant current source for each CM circuit, are connected to the ground (GND).

In the above-described configuration, each of the numerals "×N (N=1, 2, 4, or 50)" indicated by parentheses for the respective transistors M1 to M21 represents the parallel arrangement state of elements. For example, "x1" (transistors M12 to M21) indicates that the transistor has a standard element, whereas "×2" (transistors M7 to M11) indicates that the transistor has an element equivalent to two standard elements connected in parallel. In this manner, "×N" indicates that the transistor has an element equivalent to N standard elements connected in parallel.

Accordingly, since the transistors M2, M7, M12, and M17 are "×4", "×2", "×1", and "×1", respectively, when appropriate voltages are applied between the gates of these transistors and the ground, the drain currents thereof are in a ratio of 4:2:1:1.

Next, the operation of this circuit will be described. First, the description will focus solely on the CM circuit including the transistors M3, M4, M5, and M6.

The ejection execution inputting switch A becomes "1" (ON) only when ink is to be ejected.

For instance, when A="1", B=2.5V (voltage applied), C="1", and J3="1", the output of the XNOR gate X10 becomes "1". Thus, the output "1" and A="1" are input to the AND gate X2, so the output of the AND gate X2 becomes "1". The transistor M3 is thus turned ON.

Further, when the output of the XNOR gate X10 is "1", the output of the NOT gate X11 is "0", so the output "0" and A="1" are input to the AND gate X3. The output of the AND gate X3 thus becomes "0", and the transistor M5 is turned OFF.

Accordingly, the drains of the transistor M3 and M4 are connected to each other, and the drains of the transistors M6 and M5 are connected to each other. Thus, as described above, when the transistor M3 is ON and the transistor M5 is OFF, although a current flows from the transistor M4 to the transistor M3, no current flows from the transistor M6 to the transistor M5. Further, due to the characteristics of the CM circuit, when a current does not flow in the transistor M6, a current does not flow in the transistor M4, either. Further, since a voltage of 2.5 V is applied to the gate of the transistor M2, in the above-described case, from among the transistors M3, M4, M5, and M5, a corresponding current only flows from the transistor M3 to the transistor m2.

In this state, since the gate of the transistor M5 is turned OFF, a current does not flow in the transistor M6, and a current does not flow in the transistor M4 serving as the mirror, either. Although the same amount of current $I_h$ should normally flow in the resistors Rh-A and Rh-B, in the state where the gate of the transistor M3 is turned ON, since the current determined by the transistor M2 is extracted from the midpoint between the resistors Rh-A and Rh-B via the transistor M3, the current determined by the transistor M2 is added on the Rh-A side and is subtracted on the Rh-B side.

Therefore, $I_{Rh-A}>I_{Rh-H}$,

While the foregoing description is directed to the case where C="1", next, the case where C="0", that is, the case where the input of only the deflection direction change-over switch C is made different (the inputs of the other switches A, B, and JB are "1" just as described above) will be described in the following.

When C="0" and J3="1", the output of the XNOR gate X10 becomes "0". Since the input to the AND gate X2 thus becomes ("0", "1" (A="1")), the output thereof becomes "0". The transistor M3 is thus turned OFF.

Further, when the output of the XNOR gate X10 becomes "0", the output of the NOT gate X11 becomes "1", so the input to the AND gate X3 becomes ("1", "1" (A="1")), and the transistor M5 is turned ON.

When the transistor M5 is ON, a current flows in the transistor M6 and, due to this and the characteristics of the CM circuit, a current also flows in the transistor M4.

Thus, a current flows to each of the resistor Rh-A, the transistor M4, and the transistor M6 from the power source Vh. All of the current passed to the resistor Rh-A flows to the resistor Rh-B (since the transistor M3 is OFF, the current flowing out of the resistor Rh-A does not branch off to the transistor M3 side). Further, since the transistor M3 is OFF, all the current that has flown in the transistor M4 flows to the resistor Rh-B side. Furthermore, the current that has flown in the transistor M6 flows to the transistor M5.

As described above, when C="1", the current that has flown in the resistor Rh-A flows out while branching off to the resistor Rh-B side and the transistor M3 side; on the other hand, when C="0", in addition to the current that has flown in the resistor Rh-A, the current that has flown in the transistor M4 also flows to the resistor Rh-B. As a result, the currents flowing to the respective resistors Rh-A and Rh-B are in the following relationship: $I_{Rh-A}<I_{Rh-B}$. Further, the ratio at this time becomes symmetric between when C="1" and C="0".

In this way, by varying the balance of the currents flowing to the resistor Rh-A and the resistor Rh-B, a difference can be established between the bubble generation times on the respective half-split heater elements 13. The ejection direction of ink droplets can be thus deflected.

Further, the deflection direction of ink droplets can be switched to symmetrical positions with respect to the arrangement direction of the nozzles 18 between when C="1" and C="0".

While the foregoing description is directed to the case where only the deflection controlling switch J3 is turned ON/OFF, when the deflection controlling switches J2 and J1 are further turned ON/OFF, the amounts of current supplied to the resistor Rh-A and the resistor Rh-B can be controlled more finely.

That is, while the current supplied to each of the transistors M4 and M6 can be controlled with the deflection controlling switch J3, the current supplied to each of the transistors M9 and M11 can be controlled with the deflection controlling switch J2. Furthermore, the current supplied to each of the transistors M14 and M16 can be controlled with the deflection controlling switch J1.

Further, as described above, drain currents are supplied to the respective transistors in the ratio of transistor M4 and transistor M6: transistor M9 and transistor M11: transistor M14 and transistor M16=4:2:1:1. Thus, using three bits of the deflection controlling switches J1 to J3, the deflection direction of ink droplets can be changed in the eight steps of (J1, J2, J3)=(0, 0, 0), (0, 0, 1), (0, 1, 0), (0, 1, 1), (1, 0, 0), (1, 0, 1), (1, 0, 0), and (1, 1, 1).

Further, since the amounts of current can be changed by changing the voltages applied between the ground and the gates of the transistors M2, M7, M12, and M17, the deflection amount per one step can be changed while keeping the ratio between the drain currents flowing in the respective transistors at 4:2:1.

Further, as described above, the deflection direction can be changed over to the symmetric positions with respect to the arrangement direction of the nozzles 18 by means of the deflection direction change-over switch C.

In the line head 10, there are cases where the plurality of heads 11 are arranged in the width direction of the recording medium and, as shown in FIG. 2, the heads 11 are arrayed such that adjacent heads 11 are opposed to each other (each head 11 is placed at a position 180 degrees rotated with respect to the adjacent head 11). In these cases, when a common signal is supplied from the deflection controlling switches J1 to J3 to the two adjacent heads 11, the deflection direction becomes opposite between the two adjacent heads 11. In view of this, according to this embodiment, the deflection direction change-over switch C is provided so that the deflection direction of each one head 11 as a whole can be switched symmetrically.

Accordingly, in the case where the plurality of heads 11 are arranged to form the line head 10 as shown in FIG. 2, when, of the heads 11, the heads N, N+2, N+4, etc. located at the even-numbered positions are set as C="0", and the heads N+1, N+3, N+5, etc. located at the odd-numbered positions are set as C="1", the deflection direction of each head 11 in the line head 10 can be made constant.

Further, while the ejection angle correcting switches S and K are similar to the deflection controlling switches J1 to J3 in that these switches serve the purpose of deflecting the ejection direction of ink droplets, the ejection angle correcting switches S and K are switches used for correcting the ejection angle of ink droplets.

First, the ejection angle correcting switch K is a switch for determining whether or not to perform correction. The ejection angle correcting switch K is set such that correction is performed when K="1", and correction is not performed when K="0".

Further, the ejection angle correcting switch S is a switch for determining to which direction correction should be performed with respect to the arrangement direction of the nozzles 18.

For example, when K="0" (when no correction is performed), of the three inputs of the AND gates X8 and X9, one input becomes "0", so the outputs of the AND gates X8 and X9 both become "0". Thus, the transistors M18 and M20 are turned OFF, so the transistors M19 and M20 are also turned OFF. Accordingly, there is no change in the current flowing to each of the resistor Rh-A and Rh-B.

In contrast, when K="1", and S="0" and C="0", for example, the output of the XNOR gate X16 becomes "1". Thus, (1, 1, 1) is input to the AND gate X8, so the output thereof becomes "1" and the transistor M18 is turned ON. Further, since one input of the AND gate X9 is made to be "0" via the NOT gate X17, the output of the AND gate X9 becomes "0", and the transistor M20 is turned OFF. Accordingly, since the transistor M20 is OFF, a current does not flow in the transistor M20.

Further, due to the characteristics of the CM circuit, a current does not flow in the transistor M19, either. However, since the transistor M18 is ON, a current flows out from the midpoint between the resistor Rh-A and the resistor Rh-B, so that the current flows into the transistor M18. Therefore, the amount of current flowing in the resistor Rh-B can be made smaller than that in the resistor Rh-A. As a result, when correction is performed on the ejection direction of ink droplets, the impact position of each ink droplet can be corrected by a predetermined amount with respect to the arrangement direction of the nozzles 18.

While in the above-described embodiment correction is performed by means of the two bits formed by the ejection angle correcting switches S and K, finer correction can be performed by increasing the number of switches.

When the ejection direction of ink droplets is deflected by using the respective switches J1 to J3, S, and K, the current (deflection current $I_{def}$) can be represented as follows:

$$Idef=J3\times4\times Is+J2\times2\times Is+J1\times Is+S\times K\times Is=(4\times J3+2\times J2+J1+S\times K)\times Is.$$

In Expression 1, +1 or −1 is given to J1, J2, and J3, +1 or −1 is given to S, and +1 or 0 is given to K.

As can be appreciated from Expression 1, the deflection current can be set in eight steps through the setting of the respective values of J1, J2, and J3, and correction can be performed on the basis of S and K independently from the settings of J1 to J3.

Further, since the deflection current can be set in four steps as positive values and in four steps as negative values, the deflection direction of ink droplets can be set in both directions with respect to the arrangement direction of the nozzles 18. Further, the amount of deflection can be arbitrarily set.

This embodiment as described in the foregoing can provide the following effects.

First, the graininess can be reduced.

Actual printing was carried out using the liquid ejecting apparatus (line inkjet printer) according to this embodiment. The results of the observation by a microscope for the case where σ=42.3 μm and the case where σ=0 revealed that the graininess was reduced in the case where σ=0 as compared with the case where σ=42.3 μm.

Second, the sharpness of characters (appearance quality) can be enhanced.

Since pixels arranged in a tetragonal lattice manner are normally used in image processing or character processing, theoretically, the best results can be attained when the recorded dot rows are returned to the original tetragonal lattice array.

Figures 10A, 10B:
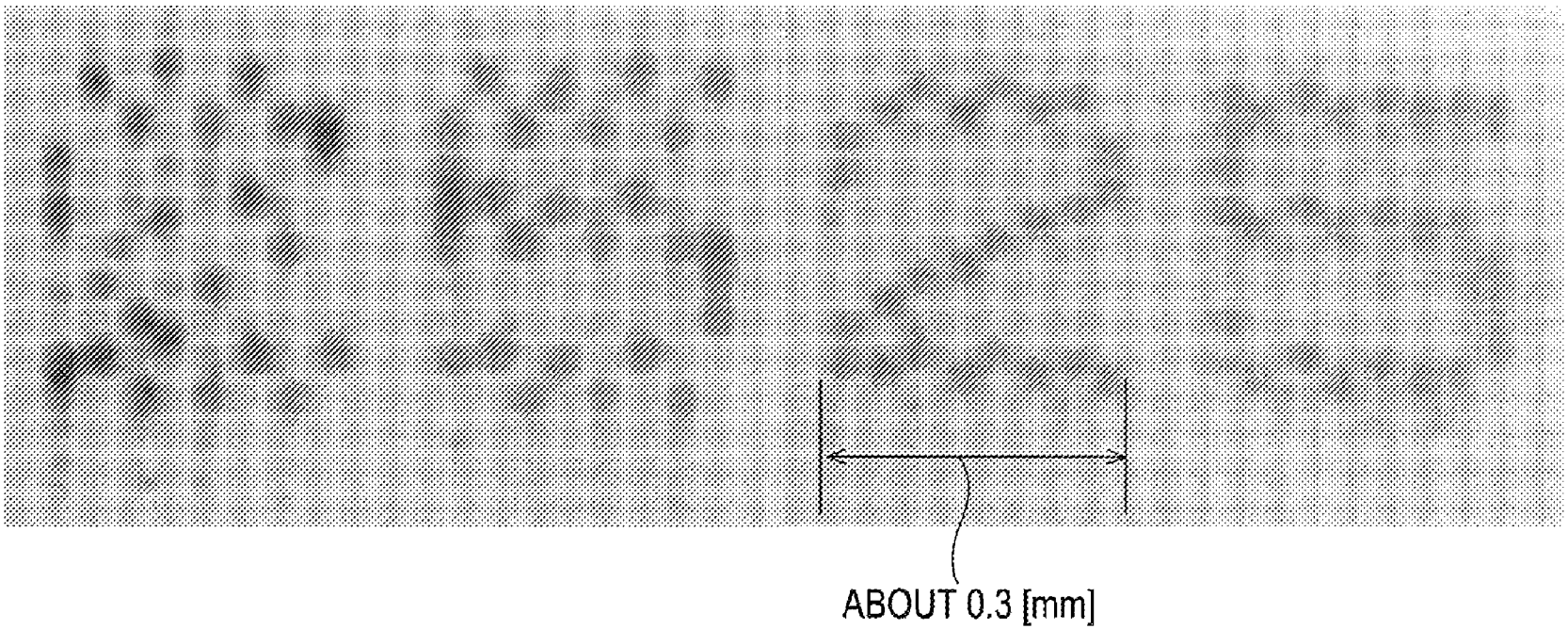
FIGS. 10A and 10B are enlarged photographs showing the results of comparison between the case where characters "25" with a character width of about 0.3 mm were recorded using an apparatus in which $\sigma$=42.3 μm and the case where the characters were recorded using an apparatus in which $\sigma$=0, respectively.

FIGS. 10A and 10B are views (enlarged photographs) illustrating the results of comparison between the case where characters "25" with a character width of about 0.3 mm were recorded using an apparatus in which σ=42.3 μm (FIG. 10A) and the case where the characters were recorded using an apparatus in which σ=0 (FIG. 10B).

The results of comparison between the two illustrations reveal that the characters are easier to read in the case of FIG. 10B.

EXAMPLE

In the following, EXAMPLE of the present invention will be described.

A line inkjet printer in accordance with the specifications as shown in FIG. 11 and having the structure as shown in FIG. 12 was used. Note that in the drawing, filter columns are arranged in a common passage; each filter column is formed by a part of the barrier layer 16 and also serves as a filter for preventing intrusion of contaminants or dust into individual passages (The same applies to FIG. 18 that will be described later).

Further, the offset between the center of each nozzle 18 and the centroid of each heater element 13 was set as the offset amount hc.

Further, the results of recording performed by setting the offset amount hc to three different values, and the ejection direction of ink droplets as determined from the results of recording were examined.

FIGS. 13A to 15B show the results at this time. Of these figures, FIGS. 13A to 15A are views (enlarged photographs taken by a microscope) showing the actually formed dot rows, and FIGS. 13B to 15B are diagrams showing the ejection direction of ink droplets inferred from the dot rows.

In FIGS. 13A to 15B, the dots are ejected at the pitch (42.3 μm) of the nozzles 18. Further, in order to reduce errors as much as possible, the measurement was made within the length (20×42.3=846 μm) formed by the dots of 20 pitches (21 dots).

Further, by measuring the distance between the vertically arranged dot rows, the inter-dot-row distance σ can be determined.

Next, in order to calculate the deflection amount Dy, as shown in FIGS. 13A to 15B, it is necessary to know how ink droplets were ejected. The deflection amount Dy is the length of the inter-dot-center distance, as measured perpendicularly to the arrangement direction of the nozzles, between the actual impact position of an ink droplet and the impact position thereof when assuming that the ink droplet is ejected straight along the normal to the nozzle surface.

In the case of the staggered array, whether the ejection was started from the nozzles 18 on the nozzle row R1 side or those on the nozzle row R2 side is previously known. Accordingly, through observation of the beginning or last portion of the dot row arrangement, it can be determined whether the arrangement of the dots is the same as or reversed from the arrangement of the nozzle surfaces.

Figure 13B:
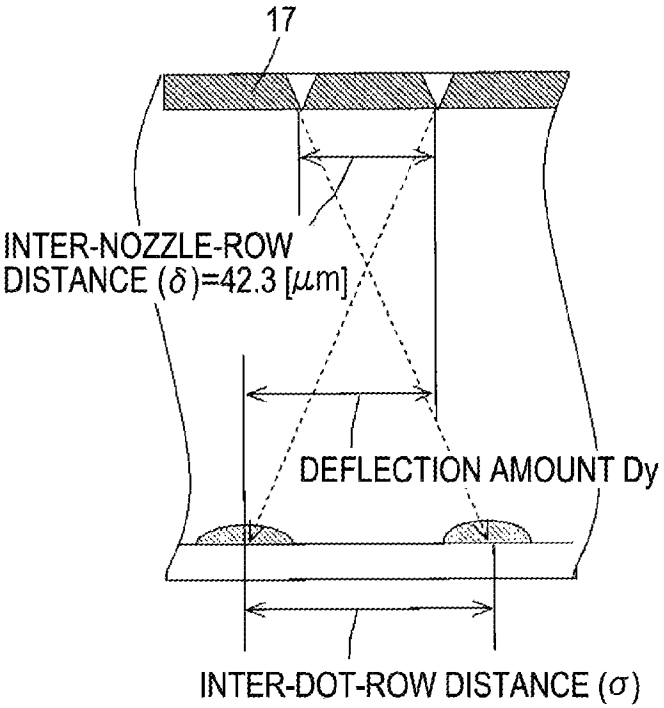
Figure 13A:
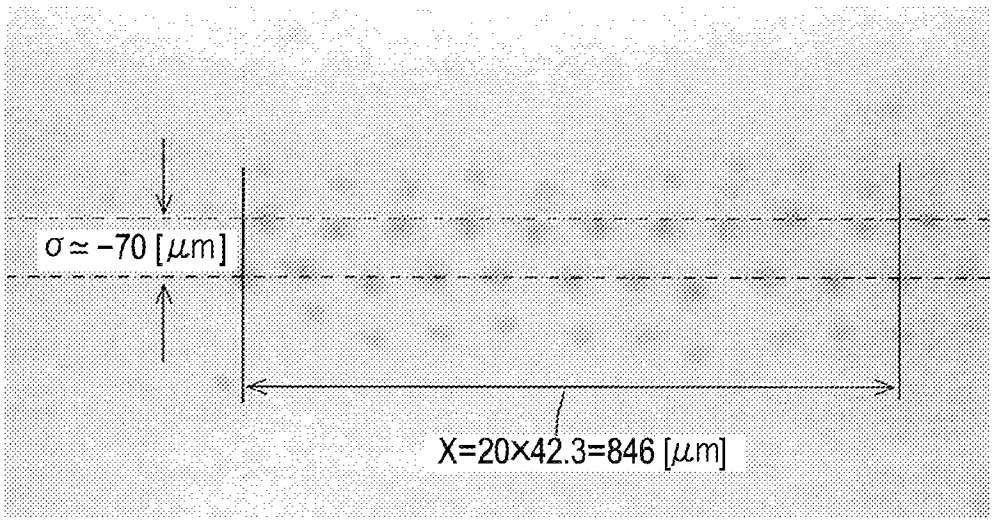
Figure 16:
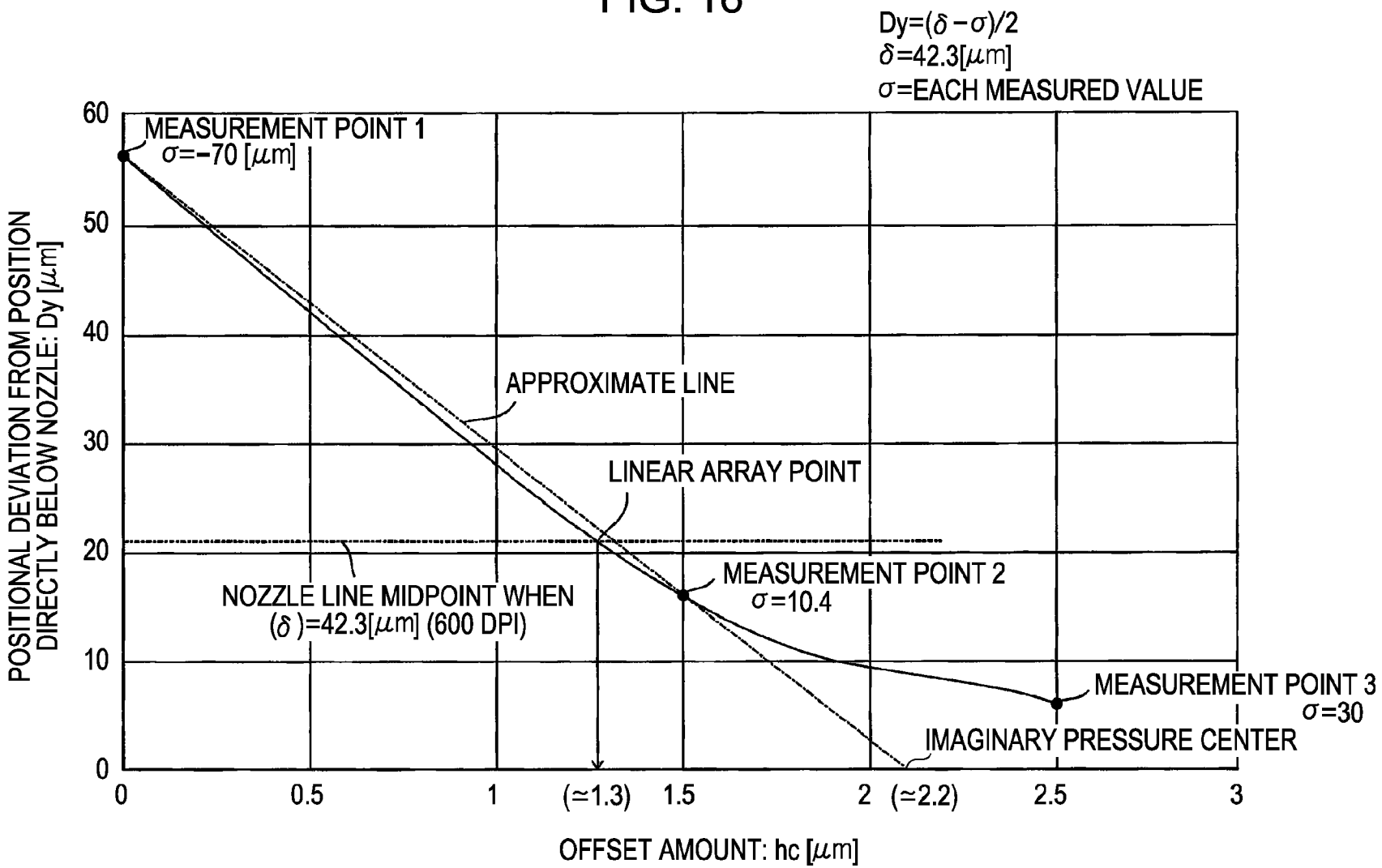
FIG. 16 shows an example of an offset amount and dot-array correcting effect of the head according to EXAMPLE.

For example, in FIG. 13A, since the beginning portion of the dot arrangement is revered from the nozzle array (which can be found from the orientation of the triangle whose apexes are formed by the first three dots as counted from the left end), it can be found that the direction of ink droplets is switched before impacting on the recording medium, so the correct value of Dy can be determined. By taking the value of σ involving no such reversal as "positive", and the value of σ involving the reversal as "negative", the value of Dy (=(δ−σ)/2) can be determined. FIG. 16 shows the calculation results.

Referring to FIG. 16, it was confirmed that in the state where the centroid of the heater elements 13 and the center of the nozzles 18 coincide with each other (hc=0), the ejection direction is deflected from the direction of the normal to the nozzle surface. Through calculation from the data shown in FIG. 16, the angle of deflection was found to be about 1.6 degrees ($\beta=\tan^{-1}(56.15/2000)\text{rad}\cong 1.6$ degrees) (FIG. 13B).

Figure 14B:
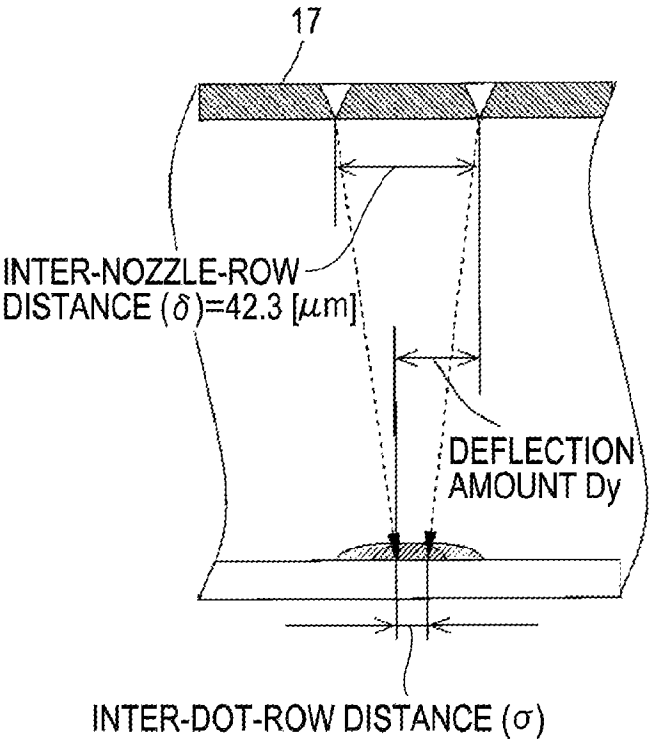
Figure 14A:
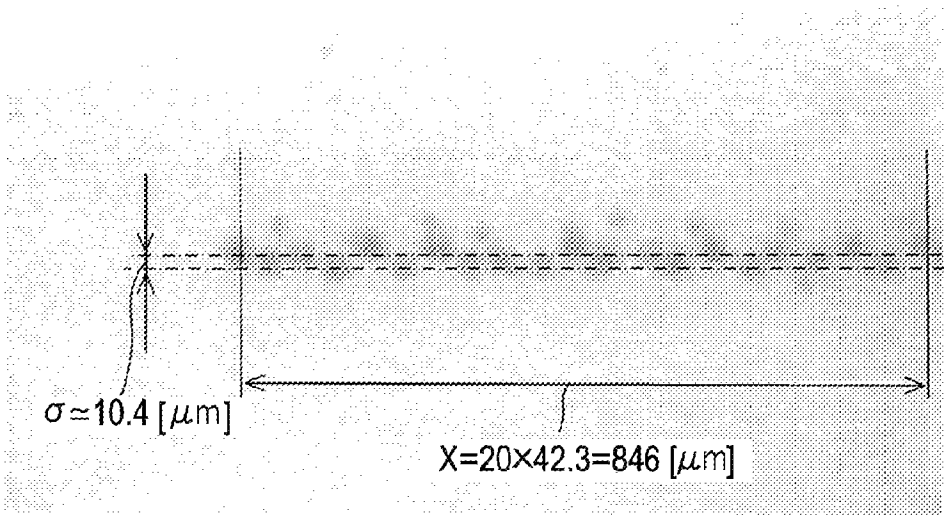
Figure 15B:
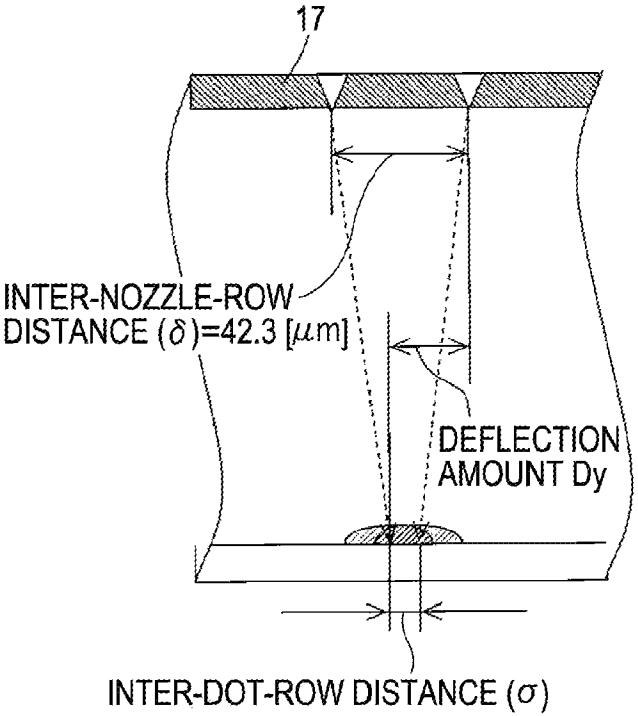
Figure 15A:
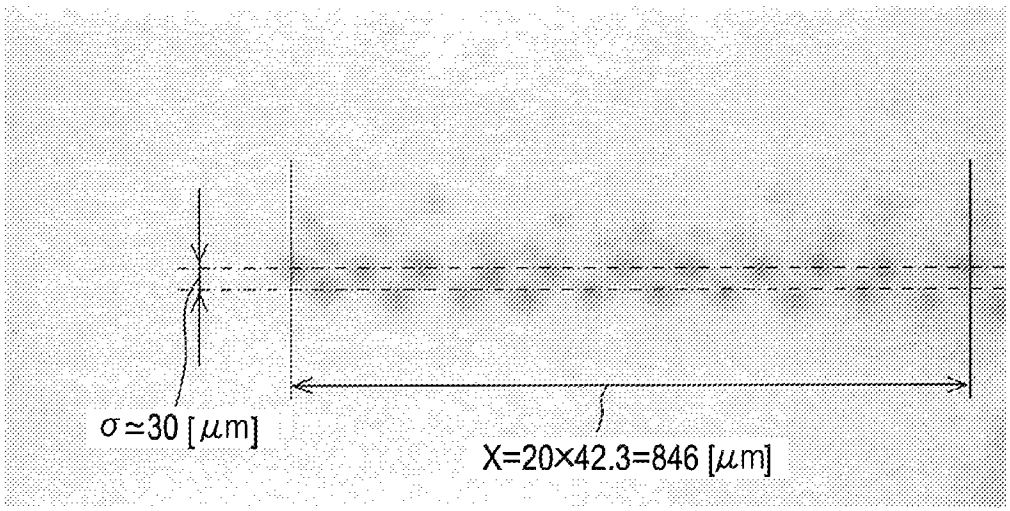

As described above, although the deflection of the ejection direction is relatively large when the offset amount hc=0, when an offset amount hc on the order of 1.5 μm is given, then, as shown in FIGS. 14A and 14B, the dots are arranged almost in a straight line.

If the region where the offset amount hc is between 0 and 1.5 μm is regarded as a straight line, the offset amount hc when the dot array extends along the straight line is estimated to be about 1.3 to 1.35 μm.

Note that in FIG. 16, the intersection (in the vicinity of hc=2.2 μm) between the extension of the approximate straight line and the X axis is indicated as the imaginary pressure center.

Figure 18:
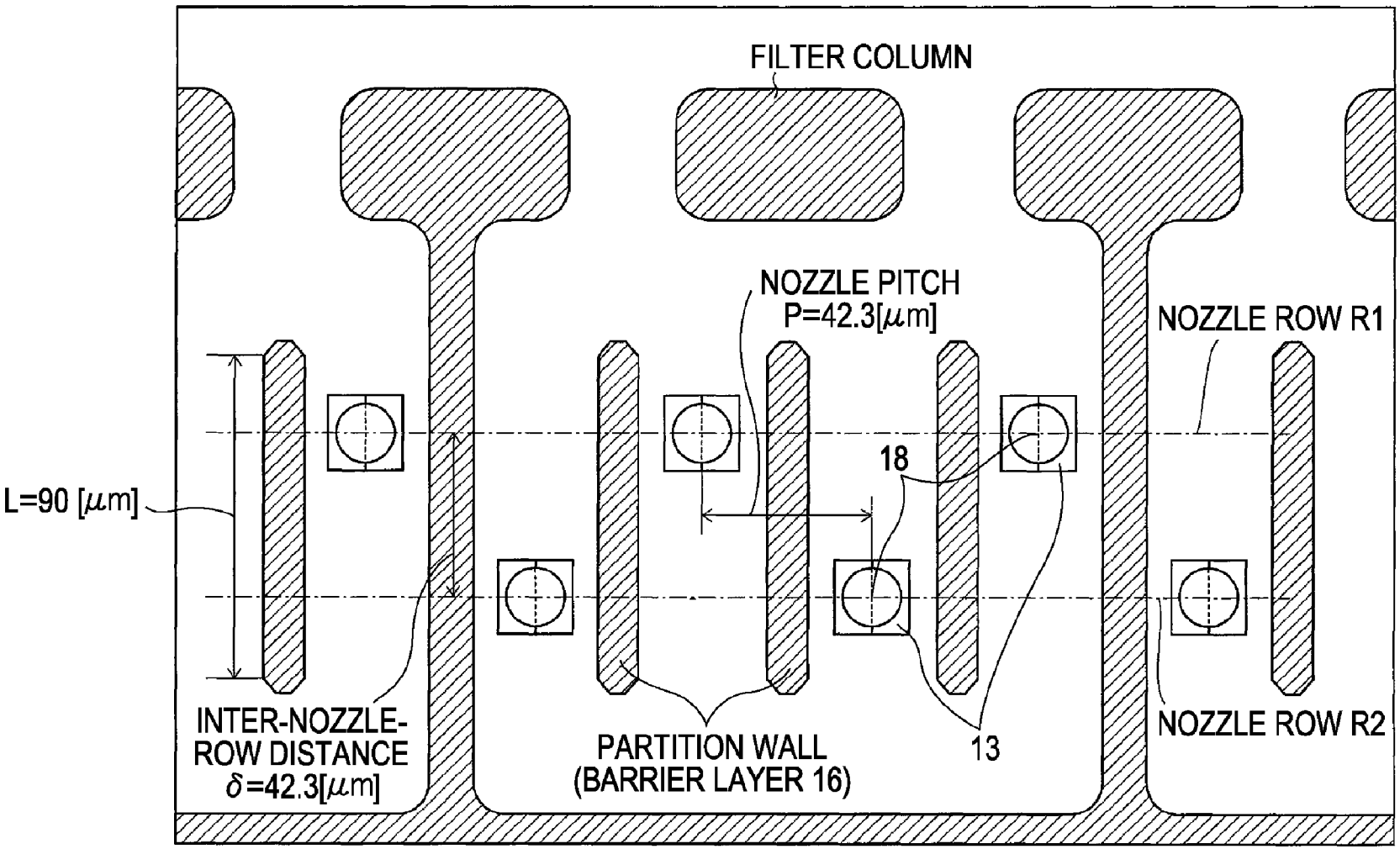
FIG. 18 is a view showing the specific structure (barrier layer structure) of the pressure groove system.

Next, the ejection characteristics (angle) with respect to the nozzle surface of the head 11 of the pressure groove system (FIG. 7) were examined. FIG. 17 shows the specifications of the heads 11 of the pressure groove system, and FIG. 18 shows the specific structure (structure of the barrier layer 16) of the pressure groove system.

Figure 19:
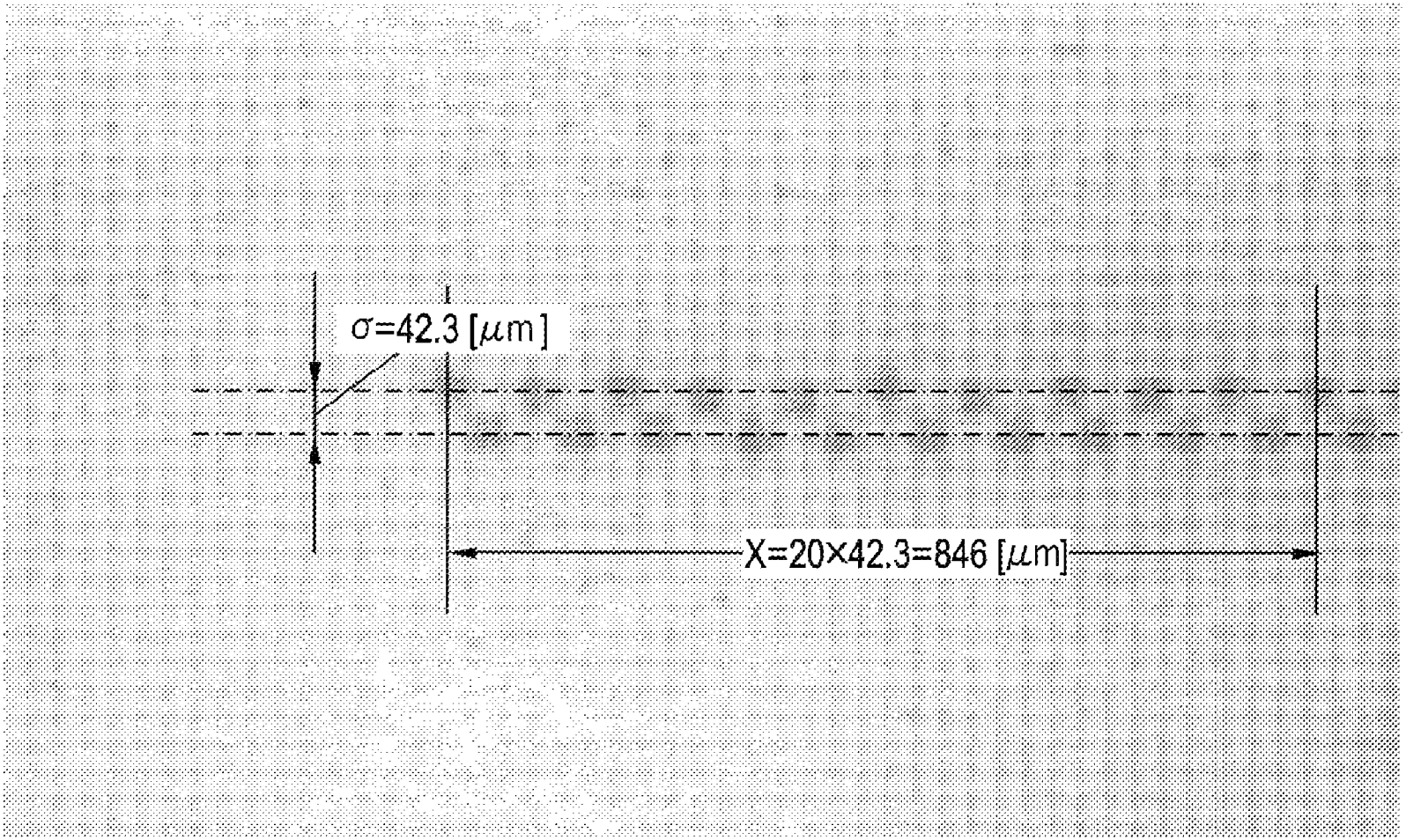
FIG. 19 is an enlarged photograph showing the results of ejection by the pressure groove system according to EXAMPLE.

Since it is known from a previously conducted experiment that the pressure center and the centroid of the heater elements 13 substantially coincide with each other in the pressure groove system, in conducting the present experiment, a head 11 in which the center of the nozzles 18 and the centroid of the heater elements 13 are made to coincide with each other was experimentally produced. FIG. 19 is a view (enlarged photograph) showing the results of ejection at this time.

Here, there is hardly any error in the value of the inter-dot-row distance σ, which is 42.3 μm that is the same as the value of δ. In contrast to the ink liquid chamber system, the centroid of the heater elements 13 becomes the pressure center. Accordingly, it was confirmed from those results as well that ink droplets are ejected along the normal to the nozzle surface.

Figure 20:
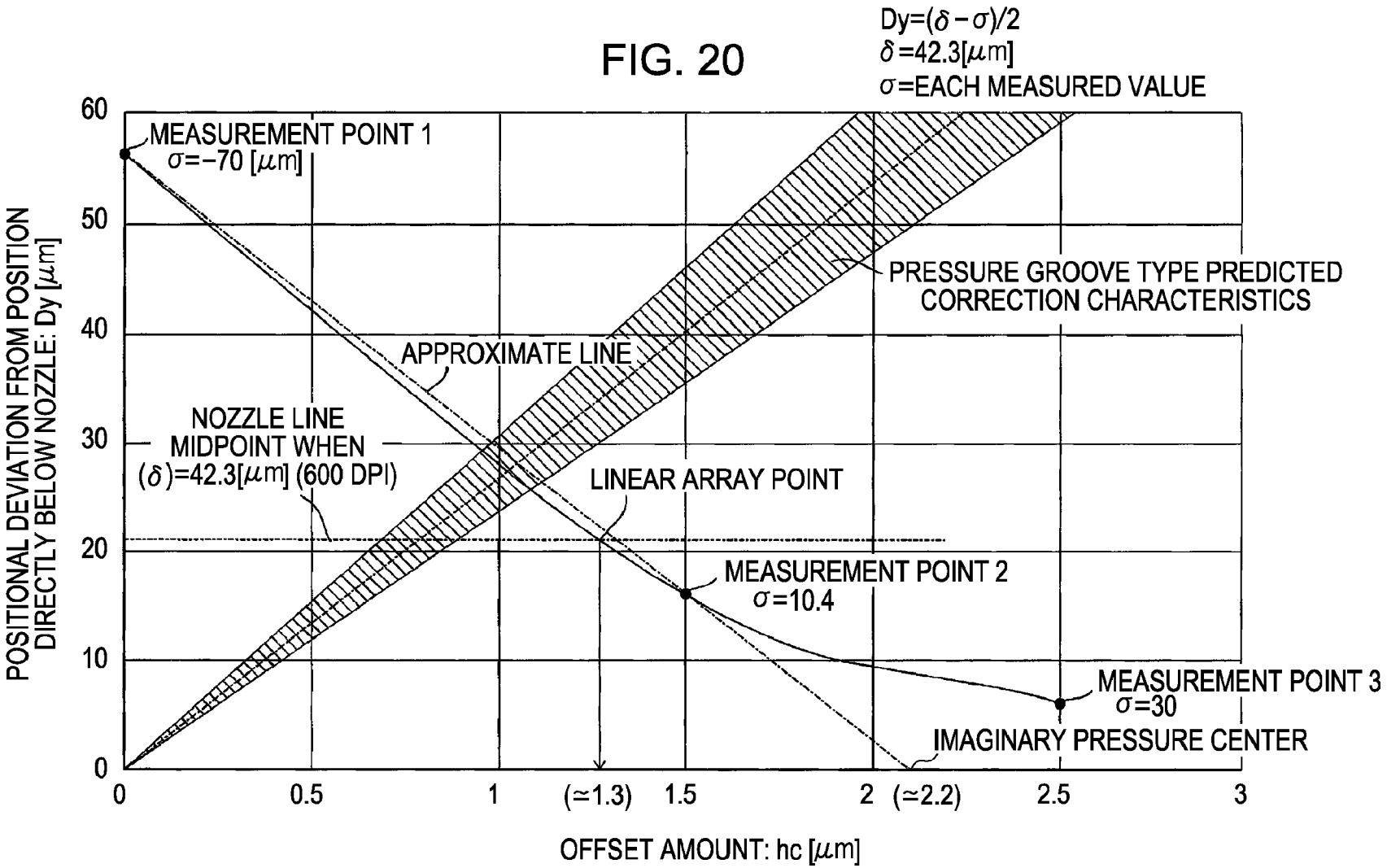
FIG. 20 is a chart obtained by adding the predicted correction characteristic region in the pressure group system to FIG. 16.

Next, the inter-dot-row distance σ when the offset amount is hc is provided in the pressure groove system is estimated. FIG. 20 is a chart obtained by adding the predicted correction characteristic region in the pressure groove system to FIG. 16.

When the ratio ($\partial\sigma/\partial hc$) of a variation in the inter-dot-row distance σ to a variation in the offset amount hc is constant and not so different from that in the ink liquid chamber system, the line that runs through the center of the region represents the characteristic. In this case, it is estimated that in order to make the line arrangement linear, for example, an offset amount hc=about 0.8 μm is required.

Lastly, the relative positional deviation between the nozzle plate 17 and each heater element 13 will be described.

While in FIGS. 3A to 3C and 4A to 4C the ink droplet ejected from each nozzle 18 on the imaginary straight line R1 side and the ink droplet ejected from each nozzle 18 on the imaginary straight line R2 side are symmetrical with respect to the nozzle surface, strictly speaking, these angles are slightly different from actual ones. For example, strictly speaking, α and β in FIGS. 3B and 3C are $\alpha\pm\Delta\alpha$ and $\beta\pm\Delta\beta$, respectively.

Those deviations actually exist, and the factor most affecting this is the deviation in the direction orthogonal to the arrangement of the nozzles 18 occurring in the step of bonding the nozzle plate 17 and the head chip 10 together.

According to the present invention, however, such bonding error does not significantly affect the final results. That is, once the relative placement of the nozzles 18 on the nozzle plate 17 is determined, and the relative positions of the heater elements 13 on the head chip 19 are determined, σ/δ=constant.

Figure 21:
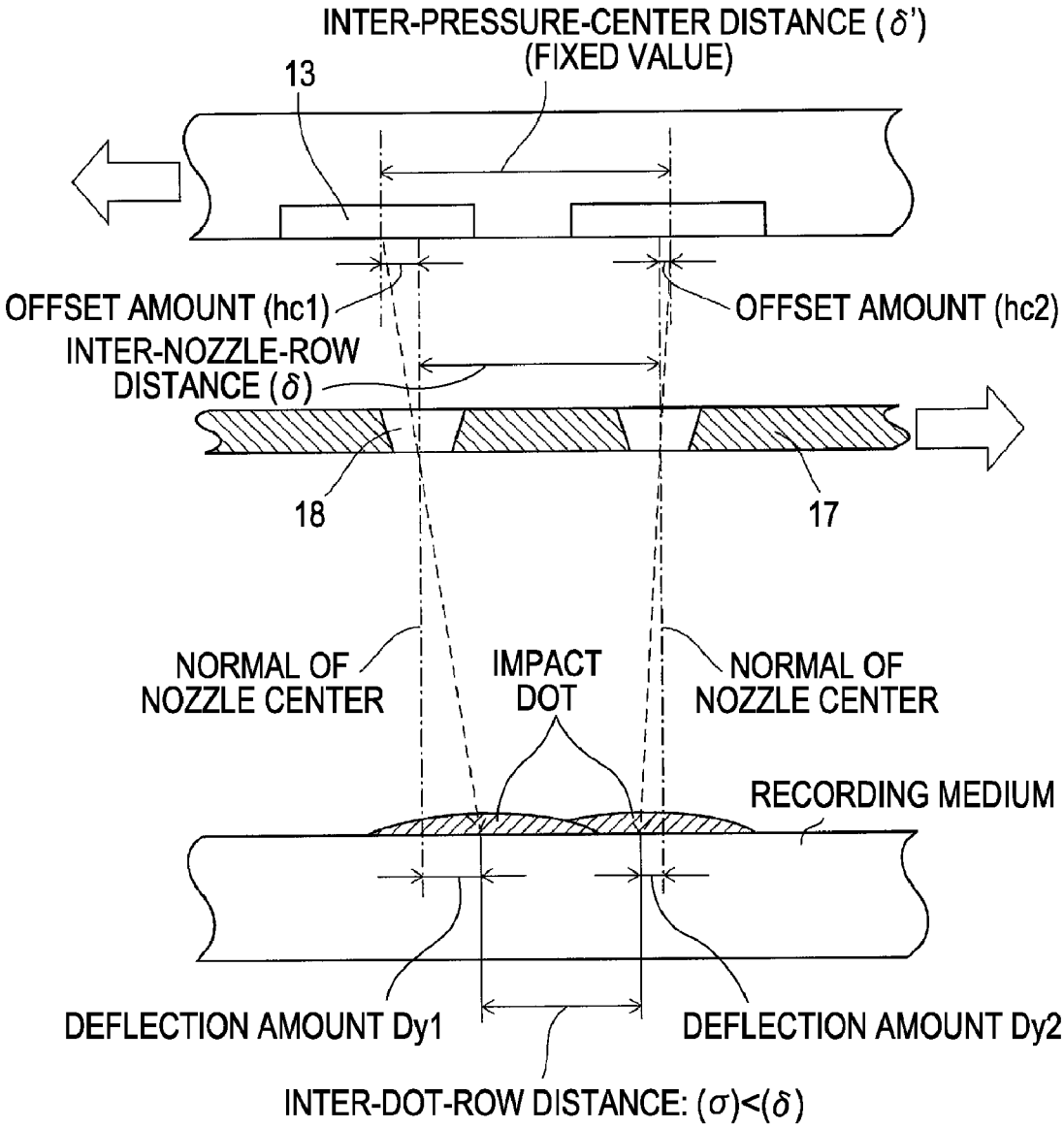
FIG. 21 is a view showing the ejection state of ink droplets as seen from the arrangement direction of the nozzles as in FIGS. 3A to 3C and FIGS. 4A to 4C.

Like FIGS. 3 and 4, FIG. 21 is a view showing the ejection state of ink droplets as seen from the arrangement direction of the nozzles 18. While in FIGS. 3 and 4 the ejection angles are depicted as being mirror-symmetrical, FIG. 21 depicts a case where the ejection angles of the respective nozzles 18 are different from each other with respect to the nozzle surface.

In FIG. 21, a case is assumed in which the relative positions of the nozzle plate 17 and head chip 19 are shifted in the direction indicated by the arrows in the drawing. Note that in FIG. 21, the pressure center of the heater elements 13 is depicted as being located at the centroid of the heater elements 13.

As described above, since the deviation between the pressure center of the heater elements 13 and the center of the nozzles 18 is in a linear relationship with the deflection amount Dy on the recording medium, Dy can be represented as follows:

Dy=k·hc (k; proportionality factor).

In FIG. 21, the following relationships are established:

$$Dy1=k\cdot hc1 \qquad \text{Expression 1}$$

$$Dy2=k\cdot hc2 \qquad \text{Expression 2}$$

However, as can be appreciated from FIG. 21, the following relationship is established:

$$\sigma=\delta-(Dy1+Dy2) \qquad \text{Expression 3}$$

Accordingly, when Expressions 1 and 2 are substituted into Expression 3 and modified, then $$\sigma=\delta-k(hc1+hc2)=\delta(1+k)-k(hc1+hc2+\delta) \qquad \text{Expression 4.}$$

Now, since "hc1+hc2+δ" is the distance between the centers of the heater elements 13, it is a fixed value.

Therefore, all the components on the right side of Expression 4 are those of fixed values. Thus, with respect to the head chip 19, once the distance δ' between the heater elements 13 and the inter-nozzle-row distance δ are determined, then σ, that is, the distance σ between the dot rows is maintained at a fixed value irrespective of hc1 and hc2, that is, irrespective of changes of the offset amounts hc1 and hc2 at the time of assembly.

While the present invention has been described in the foregoing, the present invention is not limited to the above-described embodiment but can include various modifications and the like as described above.

(1) According to the above-described embodiment, as shown, for example, in FIGS. 3B and 3C, the ejection direction of ink droplets ejected from the nozzles 18 on the imaginary straight line R1 side, and the ejection direction of ink droplets ejected from the nozzles 18 on the imaginary straight line R2 side are set to be the same or substantially the same within the margin of error. However, this should not be construed restrictively. For example, the ejection angle of ink droplets ejected from the nozzles 18 on one of the imaginary straight line R1 and R2 sides may be set to an angle that is not 90 degrees while setting the ejection angle of ink droplets ejected from the nozzles 18 on the other side to be 90 degrees (or substantially 90 degrees). That is, it suffices that the distance σ between the dot rows be made smaller than the row-to-row distance σ between the nozzles 18 by deflecting only the ejection angle of ink droplets ejected from the nozzles 18 on one of the imaginary straight line R1 and R2 sides.

(2) While in the above-described embodiment the description is directed to the example where the liquid ejecting head used is the head 11 of an inkjet printer, this should not be construed restrictively. The present invention is applicable not only to liquid ejecting heads for ejecting ink but also to liquid ejecting heads for ejecting various kinds of liquid and the like. For example, the present invention is also applicable to liquid ejecting heads for ejecting dye to dye goods and the like. Alternatively, for example, the present invention is also applicable to liquid ejecting heads for ejecting a DNA containing solution for detecting a living body sample and the like.

(3) While in the above-described embodiment the description is directed to the example of a thermal type inkjet head 11 using the heater elements 13, this should not be construed restrictively. The inkjet head 11 used may be one using heater elements other than the heater elements 13. Further, the present invention is not limited to thermal type heads but also to electrostatic ejection type or piezo type heads.

(4) While in the above-described embodiment the description is directed to the example of a line type inkjet head (line head 10), this should not be construed restrictively. The present invention is also applicable to serial type inkjet heads (serial heads).

(5) While in the above-described embodiment the description is directed to the example of a color-capable inkjet printer, this should not be construed restrictively. The present invention is also applicable to monochrome inkjet printers.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid ejecting head comprising a plurality of arrays of liquid ejecting portions each having a nozzle for ejecting a droplet, wherein:

the nozzles are alternately arranged along a straight line R1 and a straight line R2 that extend parallel to each other but at a distance δ from each other;

a distance, with respect to the direction of the straight lines R1 and R2, between two adjacent ones of the nozzles respectively arranged on the straight line R1 and the straight line R2 is set to a fixed value P; and the liquid ejecting portions arrayed along at least one of the straight lines R1 and R2 are configured so that at least one liquid is ejected at an angle of 90+β degrees from each of the liquid ejecting portions while being deflected to the other straight line side, wherein, β is equal to tan−1 (δ/2H), and H is the distance between a recording medium and a nozzle surface.

2. The liquid ejecting head according to claim 1, wherein:

the liquid ejecting portions arrayed along the straight line R1 are formed so that a liquid is ejected from each of the liquid ejecting portions while being deflected in the direction of the straight line R2; and the liquid ejecting portions arrayed along the straight line R2 are formed so that a liquid is ejected from each of the liquid ejecting portions while being deflected in the direction of the straight line R1.

3. The liquid ejecting head according to claim 1, wherein the liquid ejecting portions each include:

the nozzle; and an ejection pressure generating element arranged below the nozzle, for imparting an ejection pressure to the liquid to be ejected; and wherein a distance δ' is set to be larger than the distance δ, the distance δ' being a distance, with respect to a direction orthogonal to the straight lines R1 and R2, between center points of the ejection pressure generating elements of adjacent ones of the liquid ejecting portions that are respectively arranged on the straight lines R1 and R2, the ejection pressure being generated at the center points.

4. The liquid ejecting head according to claim 1, wherein the liquid ejecting portions each include:

the nozzle; and a heater element arranged below the nozzle, for imparting an ejection pressure by heating to the liquid to be ejected; and wherein a distance δ' is set to be larger than the distance δ, the distance δ' being a distance, with respect to a direction orthogonal to the straight lines R1 and R2, between ejection pressure centers of the heater elements of adjacent ones of the liquid ejecting portions that are respectively arranged on the straight lines R1 and R2.

5. The liquid ejecting head according to claim 1, further comprising ejection direction changing means for enabling an ejection direction of the liquid ejected from the nozzle to be changed between at least two different directions with respect to the direction of the straight lines R1 and R2.

6. A liquid ejecting apparatus comprising a liquid ejecting head having a plurality of arrays of liquid ejecting portions each having a nozzle for ejecting a droplet, the liquid ejecting apparatus being configured to cause at least one liquid ejected at an angle of 90+β degrees from the nozzle of each of the liquid ejecting portions to be impacted on a target liquid-impacting object that is arranged at a predetermined distance, wherein:

the nozzle is arranged along each of an straight line R1 and an straight line R2 that are arranged in parallel at a distance δ from each other, and a distance, with respect to the direction of the straight lines R1 and R2, between two adjacent ones of the nozzles respectively arranged on the straight line R1 and the straight line R2 is set to a fixed value P; and the liquid ejecting portions arrayed along at least one of the straight lines R1 and R2 are formed so that a liquid is ejected from each of the liquid ejecting portions while being deflected to the other straight line side;

a distance σ between a line S1, which connects centers of a row of dots formed by the liquid ejecting portions arrayed along the straight line R1, and a line S2, which connects centers of a row of dots formed by the liquid ejecting portions arrayed along the straight line R2, with respect to a direction orthogonal to the rows of dots is set to be smaller than the distance δ; and β is equal to tan−1 (δ/2H), and H is the distance between a recording medium and a nozzle surface.

7. The liquid ejecting apparatus according to claim 6, wherein:

the liquid ejecting portions arrayed along the straight line R1 are formed so that a liquid is ejected from each of the liquid ejecting portions while being deflected in the direction of the straight line R2; and the liquid ejecting portions arrayed along the straight line R2 are formed so that a liquid is ejected from each of the liquid ejecting portions while being deflected in the direction of the straight line R1.

8. The liquid ejecting apparatus according to claim 6, wherein the liquid ejecting portions each include:

the nozzle; and an ejection pressure generating element arranged below the nozzle, for imparting an ejection pressure to the liquid to be ejected; and wherein a distance δ' is set to be larger than the distance δ, the distance δ' being a distance, with respect to a direction orthogonal to the straight lines R1 and R2, between center points of the ejection pressure generating elements of adjacent ones of the liquid ejecting portions that are respectively arranged on the straight lines R1 and R2, the ejection pressure being generated at the center points.

9. The liquid ejecting apparatus according to claim 6, wherein the liquid ejecting portions each include:

the nozzle; and a heater element arranged below the nozzle, for imparting an ejection pressure by heating to the liquid to be ejected; and wherein a distance δ' is set to be larger than the distance δ, the distance δ' being a distance, with respect to a direction orthogonal to the straight lines R1 and R2, between ejection pressure centers of the heater elements of adjacent ones of the liquid ejecting portions that are respectively arranged on the straight lines R1 and R2.

10. The liquid ejecting apparatus according to claim 6, wherein an ejection direction of each of the liquid ejecting portions is set so that the distance σ between the line S1 and the line S2 becomes 0.

11. The liquid ejecting apparatus according to claim 6, wherein an ejection direction of each of the liquid ejecting portions is set so that the distance σ becomes ½ of the distance P.

12. The liquid ejecting apparatus according to claim 6, further comprising ejection direction changing means for enabling an ejection direction of the liquid ejected from the nozzle to be changed between at least two different directions with respect to the direction of the straight lines R1 and R2.

* * * * *